US005694742A

United States Patent [19]

Elliott et al.

[11] Patent Number: 5,694,742

[45] Date of Patent: Dec. 9, 1997

[54] METHOD AND APPARATUS FOR PRODUCING A STRAPLESS BALE OF COMPRESSED FIBER

[76] Inventors: Kenneth W. Elliott, 306 Old Country Home Rd., Asheville, N.C. 28806; C. Thomas Curles, 211 Cedar Lake Cir., Cordele, Ga. 31015; Alex Hollingsworth, 124 N. Main St., Hendersonville, N.C. 28792; David P. Zachary, 44 Lochencove Rd., Brevard, N.C. 28712; Thomas C. Sisk, Fairmont Rd., Chandler, N.C. 28715; Michel D. Vaniman, P.O. Box 985, Arden, N.C. 28704

[21] Appl. No.: 734,674

[22] Filed: Oct. 21, 1996

Related U.S. Application Data

[63] Continuation of Ser. No. 286,869, Aug. 5, 1994, abandoned.

[51] Int. Cl.[6] ..... B65B 1/24; B65B 63/02

[52] U.S. Cl. ..... 53/436; 53/438; 53/523; 53/525; 100/42; 100/218; 100/237

[58] Field of Search ..... 53/436, 438, 523, 53/525; 100/189, 218, 237, 42

[56] References Cited

U.S. PATENT DOCUMENTS

| | | | |
|---|---|---|---|
| 2,209,740 | 7/1940 | Steinhauer | 100/30 |
| 3,088,499 | 5/1963 | Rieger | 53/529 |
| 3,580,166 | 5/1971 | Longo | 53/529 |
| 3,585,925 | 6/1971 | Fox | 100/218 |
| 3,608,476 | 9/1971 | Price | 53/529 |
| 3,968,619 | 7/1976 | Fishburne | 53/24 |
| 4,006,576 | 2/1977 | Tetenborg | 53/527 |
| 4,036,359 | 7/1977 | Strickland | 53/529 |
| 4,040,230 | 8/1977 | Pessel et al. | 53/24 |
| 4,096,799 | 6/1978 | Zupancic | 100/215 |
| 4,162,603 | 7/1979 | Strömberg | 53/438 |
| 4,343,131 | 8/1982 | McCormick et al. | 53/397 |

OTHER PUBLICATIONS

*International Fiber Journal*, Dec. 1992, p. 24.

Fishburne International, *Strapless Horizontal Fiber Baler*, (brochure).

Fishburne International, *Strapless Vertical Fiber Baler*, (brochure).

*Primary Examiner*—Lowell A. Larson
*Assistant Examiner*—Gene L. Kim
*Attorney, Agent, or Firm*—Cort Flint; Henry S. Jaudon

[57] ABSTRACT

An apparatus and method for producing strapless bales of highly compressible textile fibers is disclosed, wherein a compressed block of the fibers is ejected and expanded into a flexible bag. The apparatus includes a supply chamber for supplying loose fibers to a tramping chamber which is stationary. A ram assembly repeatedly tramps the fibers to form a compacted fiber mass which is then formed into a compressed fiber block within a stationary compression chamber disposed in fiber transfer relation to the stationary tramping chamber. The compressed fiber block is ejected transverse to the compression chamber through an ejection sleeve about which an oversized flexible bag is fitted. Due to the fact that the bag is of a greater size than the cross section of the ejection sleeve and due to the stretch and flexibility of the bag, the compressible fibers in the compressed fiber block undergo an expansion process wherein the flexible bag is filled with the compressible fibers to form a strapless bale.

29 Claims, 37 Drawing Sheets

METHOD AND APPARATUS FOR PRODUCING A STRAPLESS BALE OF COMPRESSED FIBER

This application is a continuation of application Ser. No. 08/286,869 filed on Aug. 5, 1994 now abandoned.

BACKGROUND OF THE INVENTION

This invention relates to the production of a strapless bale of compressed textile fibers wherein a compressible block of fibers is placed into a flexible bag without the need of straps encircling the bale.

Previously, textile fibers had been packaged by forming a rectangular bale of the compressed fibers and placing straps about the bale of fibers to maintain the bale compressed for shipping and handling. Typically, the straps are made of metal which may be dangerous in use. In handling the strapped bales, personal injury as well as property damage has occurred from the breaking of straps as well as from other dangerous properties of the straps. The machinery required to bale the fibers and place the straps around the compressed bales of fibers also has produced considerable problems in the textile and other industries where fibers are utilized.

It has been known to bale tobacco particles by forming a compacted cake of the tobacco, and moving the cake of tobacco into a laterally extending sleeve through which the cake is inserted into a bag or carton fitted over the sleeve. The container is positively moved off of the sleeve at essentially the same rate at which the cake emerges from the sleeve and steel strapping can be placed around the bag while the bag is still on the sleeve. A method and apparatus for producing bales of compacted tobacco is disclosed in U.S. Pat. No. 4,343,131 wherein the compacted bales of tobacco are strapped. In such a machine, it is known to offset the discontinuous, adjacent chamber surfaces (e.g. chamber wall, ejector door and sleeve) on the compaction side of the tobacco cake to facilitate pushing of the cake through the sleeve. While this method and apparatus is suitable for producing bales of tobacco, it is not entirely satisfactory for producing bales of fibers due to the inherent differences in the nature of fibers and tobacco. For example, textile fibers are much more resilient and compressible than are tobacco particles presenting different problems in the baling process.

U.S. Pat. No. 2,209,740 discloses a cotton gin press of the twin-box type having a plurality of dogs which retain the cotton as it is rotated in a filling box on a turntable to a press ram structure. Considerable problems are involved with utilizing a turntable-type filling and baling apparatus in connection with baling textile fibers, and in particular, with forming a strapless bale of compressed fibers. In filling a filling box, it is known to fill and tramp compressible cotton fibers repeatedly in order to completely fill the box prior to rotation to the main press box.

It is known to compact various other materials in one direction and then move the compacted package of material in a transverse direction. Generally speaking, U.S. Pat. Nos. 4,096,799; 4,040,230 and 3,585,925 show various methods and apparatus for forming packages of various, relatively non-compressible materials such as wire, felt pads, and garbage, respectively. However, these devices do not relate to analogous problems or fields to which the present invention is related. The prior art has not provided an apparatus and method for producing unstrapped bales of highly compressible fibers in an efficient manner at high rates, namely in flexible bags, and wherein the problems of metal strapping is avoided.

Accordingly, an object of the present invention is to provide a method and apparatus for producing strapless bales of compressible fibers.

Another object of the present invention is to provide a method and apparatus for producing strapless bales of compressible fibers at a high rate of production.

Another object of the invention is to provide a method and apparatus for producing strapless bales of compressed fibers at a high rate of production wherein the stages of the production may be overlapped in the method and apparatus so that while one stage is being performed on the fibers, another stage may be ongoing to assure a high rate of production.

Yet another object of the present invention is to provide a commercial process and apparatus for producing strapless bales of compressed fibers which requires a minimum of moving parts so that a high rate of reliable commercial production may be had.

Still another object of the present invention is to provide a method and apparatus for producing strapless bales of compressed fibers wherein a commercial apparatus can be had which withstands the high pressures encountered in the handling of compressed blocks and bales of fibers yet which can accomplish a high rate of commercial production with apparatus having a relatively small number of moving parts.

SUMMARY OF THE INVENTION

The above objectives are accomplished according to the invention by providing an apparatus and method for producing a strapless bale of compressed fibers. The apparatus includes a fiber supply of loose compressible fibers, a tramping chamber for receiving the loose fibers, a reciprocating platen disposed within the tramping chamber for repeatedly tramping successive deposits of loose fibers to create a compacted fiber mass during a tramping cycle. A controller actuates the reciprocating platen repeatedly during the tramping cycle until a compacted fiber mass is formed containing a prescribed amount of fibers. A plurality of retaining elements are operatively associated with the tramping chamber for retaining the compacted fibers within the tramping chamber while the successive deposits of the loose fibers are compacted to produce the compacted fiber mass. A compression chamber contains a compacted fiber mass which includes a compression section in which the compacted fiber mass is compressed in the same direction in which the loose fibers are compacted to produce a compressed fiber block during a compression cycle. An ejector platen is associated with the compression chamber for ejecting the compressed fiber block through an ejection sleeve in a direction transverse to the direction of compression. A flexible oversized bag is fitted over the sleeve into which the compressed fiber block expands as it is ejected from the ejector sleeve during an ejection cycle.

In one embodiment, the tramping chamber and compression chamber are disposed in axial alignment with each other, and a plurality of tramping cylinders reciprocate a main platen which both tramps and compresses the fibers. A main ram cylinder is operatively associated with the plural tramping cylinders to move the platen. A coupling connects the main ram cylinder to the platen so that the main ram cylinder is disengaged from the platen during the tramping cycle but is engaged with the platen and moves the platen forward with the tramping cylinders during the compression cycle. A moveable ejector door is disposed between the bale ejection sleeve and the compression chamber. The ejector door has an ejection opening with a cross-section slightly smaller than a cross-section of the ejection sleeve so that a first edge of the ejection opening corresponds to a compression side of the bale and is off-set with respect to the compression section while a second edge of the ejection opening is generally flush with an opposing wall of the compression section. If the tramping chamber and the compression chamber are axially aligned in a horizontal direction, a horizontal chamber opening is provided through which loose fibers are supplied to the tramping chamber. A moveable shelf door is operatively associated with the chamber opening for closing the chamber opening upon reciprocation of the platen during the tramping cycle when the platen is disposed on a side of the chamber opening associated with the tramping chamber so that the supply of loose fibers may continue during the tramping cycle. If the tramping chamber and the compression chamber are axially aligned in a vertical direction. The compression chamber includes a horizontal chamber opening through which the compacted fiber mass passes into the compression section during the compression cycle. A moveable shelf door, moveable in unison with the ejector platen, is associated with the chamber opening for closing the chamber opening during the ejection cycle so that the tramping cycle may continue during the ejection cycle. The reciprocating main platen forms a wall of the compression chamber during the ejection cycle. The ejector platen forms a wall of the compression section during the compression cycle.

In another embodiment, the tramping chamber and the compression chamber are advantageously laterally off-set from each other to increase the production rate. The off-set tramping chamber and compression chamber are stationary, and are in open fiber transfer relation with each other through a transfer opening. At least one reciprocating transfer plate is provided for transferring the compacted fiber mass from the tramping chamber to the compression chamber. The transfer plate forms a wall of the compression chamber during the compression cycle. A moveable main platen is reciprocally carried in the compression chamber and a moveable secondary platen is carried in alignment with the main platen. The main platen and secondary platen compress the compacted fiber mass between a compression position of the main platen and a spaced compression position of the secondary platen to form the compressed fiber block. The compression section is defined between the main platen and secondary platen when located at the compression positions during the compression cycle. The compression section is defined in a portion of the compression chamber spaced from the ejection sleeve. Advantageously, the main and secondary platens are horizontal to form top and bottom platens. The compression section has a cross-section generally equal to or less than a cross-section of the ejection sleeve. The main platen and secondary platen move in unison to transfer the compressed fiber block from the compression section to an alignment with an ejection opening of the ejection sleeve. The main platen is disposed at the compression position in the compression chamber during the ejection cycle to form a wall of the tramping chamber so the tramping cycle may continue during the ejection cycle. Preferably, a first transfer plate and a second transfer plate are disposed parallel and vertically stacked in a side-by-side arrangement forming a wall of the tramping chamber in a retracted position. The first and second transfer plates are operatively associated to transfer the compacted fiber mass to the compression chamber. The second transfer plate forms a portion of the wall of the compression chamber during the ejection cycle. The first transfer plate retracts to form a wall of the tramping chamber during the ejection cycle so that the tramping cycle may continue. The ejector platen includes an elongated, generally L-shaped door shelf carried with the platen that closes the compression chamber opening on a top and side of the opening during the ejection cycle.

According to the invention, a method is provided for producing a strapless bale of compressed fibers wherein loose compressible fibers are supplied. The method includes tramping the loose fibers to create a compacted fiber mass of loosely compacted fibers, and retaining the fiber mass within a tramping chamber while successive deposits of the loose fibers are supplied and compacted in the compacted fiber mass to produce a compacted fiber mass containing a prescribed amount of fibers during a tramping cycle. Next, the compacted fiber mass is compressed mass within a compression chamber in the same direction the fiber mass is tramped to create a compressed fiber block during a compression cycle. The compressed fiber block is ejected through an ejection sleeve having a rectangular cross-section in a direction transverse to the direction of compression. A flexible bag is provided which has a cross-section greater than the ejection sleeves' cross-section to define an expansion area. The compressed fiber block is ejected into a bag during an ejection cycle, and subjected to an expansion process in the direction of compression as it moves into the flexible bag whereby the compressed fibers expand in the expansion area of the bag without bursting to produce a strapless fiber bale. The compacted fiber mass and the compressed fiber block are formed in respective tramping and compression chambers which are in axial alignment with one another. The loose fibers are tramped into a compacted fiber mass using a plurality of tramping cylinders during the tramping cycle, and tramped fibers are compressed using the plurality of tramping cylinders and a main ram cylinder which is disengaged with the operation of the plurality of tramping cylinders during the tramping cycle. In another embodiment, the compacted fiber mass is formed by tramping the loose fibers in a tramping chamber generally parallel to and laterally off-set from a compression section in which the compressed fiber block is formed. The compacted fiber mass is compressed using a moveable main platen and a moveable bottom platen, and the method includes compressing the compacted fiber mass between a bottom position of the main platen and a top position of the bottom platen in the compression section above the ejection chamber. The compression chamber has a cross-section generally equal to or less than that of the ejection sleeve. Next, the method includes moving the compressed fiber block in the compression chamber by moving the main platen and bottom platen in unison and aligning the compressed fiber block with an ejector opening of the ejection sleeve.

Preferably, the method includes supplying and tramping the loose fibers are supplied to and tramped in the tramping chamber while the main platen is extended to form a side wall of the tramping chamber. The loose fibers are supplied to a supply chamber which is laterally off-set from the tramping chamber, and pushed into the tramping chamber. Next, the method includes transferring compacted fiber mass from the tramping chamber through a transfer opening into the compression chamber using at least one transfer plate which forms a wall of the compression section. Alternately, the fiber mass is transferred to the compression chamber using a first movable transfer plate and a second movable transfer plate disposed in parallel relation, and the method comprises forming a wall of the compression chamber with the first and second movable plates during the compression cycle, retracting the first transfer plate when the main platen has reached a bottom most position in the compression cycle so that the supplying and tramping cycle may resume during the ejection cycle, and retracting the second transfer plate after the compression chamber opening is closed by a movable shelf door during the ejection cycle to continue the tramping cycle.

The method of producing a strapless bale of compressible textile fibers in stationary, laterally off-set tramping chamber and compression chambers quite advantageously includes the sequence of supplying looser fibers to the tramping chamber, extending the tramping plate to compact the loose fibers and form a compacted fiber mass during a tramping cycle, retracting the main platen after the tramping cycle, and transferring the compacted fiber mass from the tramping chamber to the compression chamber. Next, the method includes extending the main platen to compress the compacted fiber mass in the compression chamber to form a compressed fiber block during a compression cycle. Next, the method includes ejecting the compressed fiber block in a direction transverse to a direction of compression through an ejection sleeve and into a flexible bag fitted about the ejection sleeve. The compressed fiber bale is ejected into the flexible bag in a manner that the compressed fibers are subjected to an amount of expansion in the flexible fiber bag for producing a strapless bale of compressed fibers. Next, the method includes maintaining the main platen to form a wall of the tramping chamber and close the transfer opening to commence a tramping cycle during the ejection cycle. The method includes transferring the compacted fiber mass by extending at least one transfer plate transverse to the direction of tramping to move the compacted fiber mass laterally into the compression chamber, and maintains the transfer plate extended to form a wall of the compression chamber during the compression cycle. Next, the extended transfer plate is retracted after the main platen is extended to close the transfer opening, and resuming the tramping cycle. Alternately, the method includes transferring the compacted fiber mass using a first and second reciprocating transfer plates disposed generally in a parallel manner. A first of the transfer plates is retracted when the main platen is extended to resume the tramping cycle, and the second transfer plate is left in the extended position to form a wall of the compression chamber during the compression cycle. The second transfer plate is retracted after the ejector platen has been extended to eject the fiber block, and close a corresponding portion of the transfer opening with a door shelf moving in unison with the ejector platen.

In accordance with another advantageous embodiment of off-set stationary tramping and compressing chamber, the method includes providing a secondary movable platen in axial alignment with the main platen and moving the secondary platen to a transfer position adjacent the transfer opening in the compression chamber. Next, the method includes transferring the fiber mass to a position between the main platen and secondary platen in the compression chamber, and compressing the fiber mass between the main and secondary platens to form a compressed fiber block. Next, the method includes moving the main platen and secondary platen together in unison to position the compressed fiber block in the compression chamber into alignment with an ejection opening of the ejection sleeve through which the compressed fiber block is ejected transversely from the compression chamber. Next, the method includes extending the ejector platen to eject the fiber block, closing an opening to the compression chamber by moving a shelf door in unison with the ejector platen, and retracting the main platen to form a wall of the tramping chamber and resume the tramping cycle.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

Figure 1:
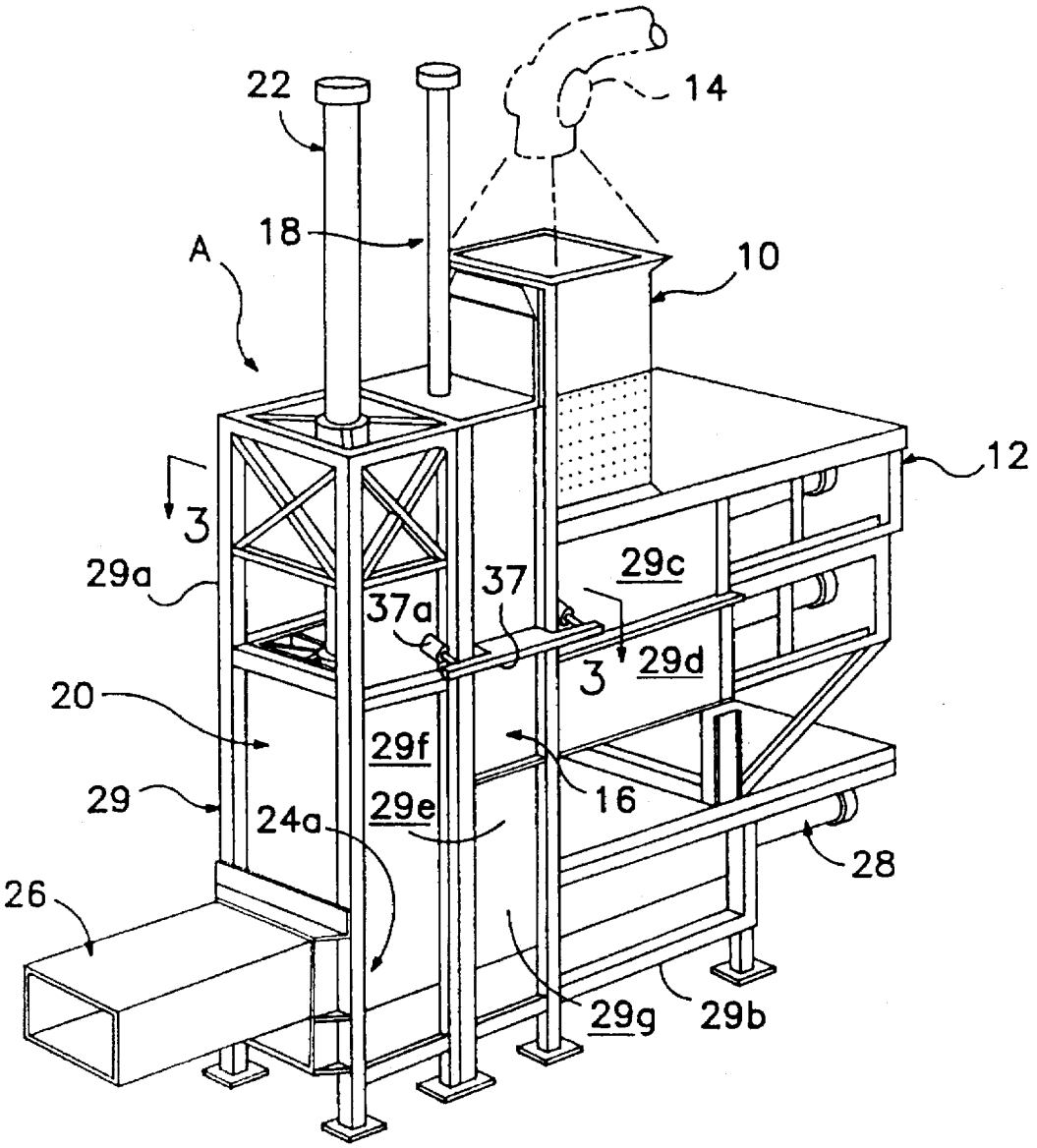
FIG. 1 is a perspective view illustrating an apparatus and method for producing a strapless bale of compressible fibers according to the invention.
Figure 12:
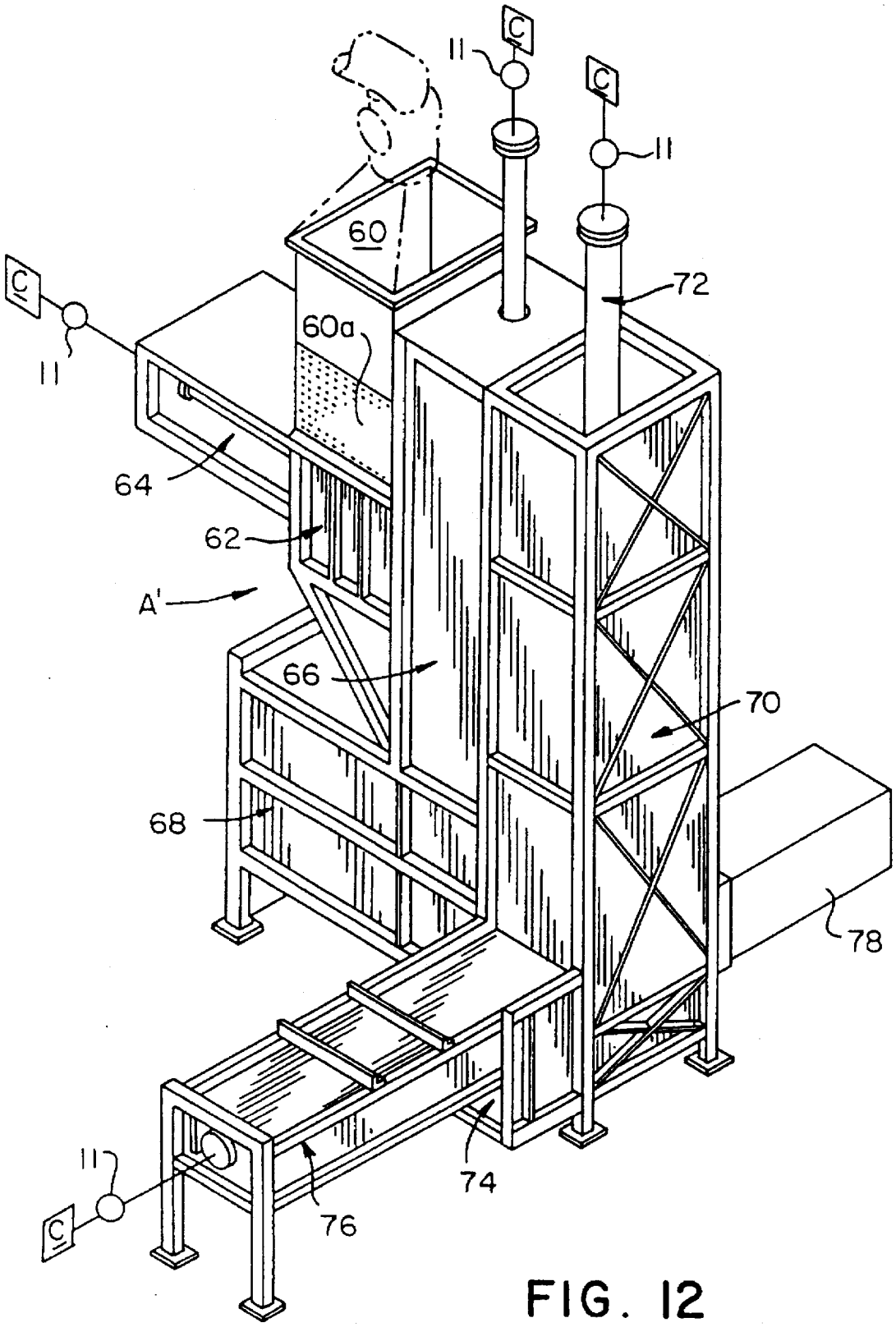
Figure 13:
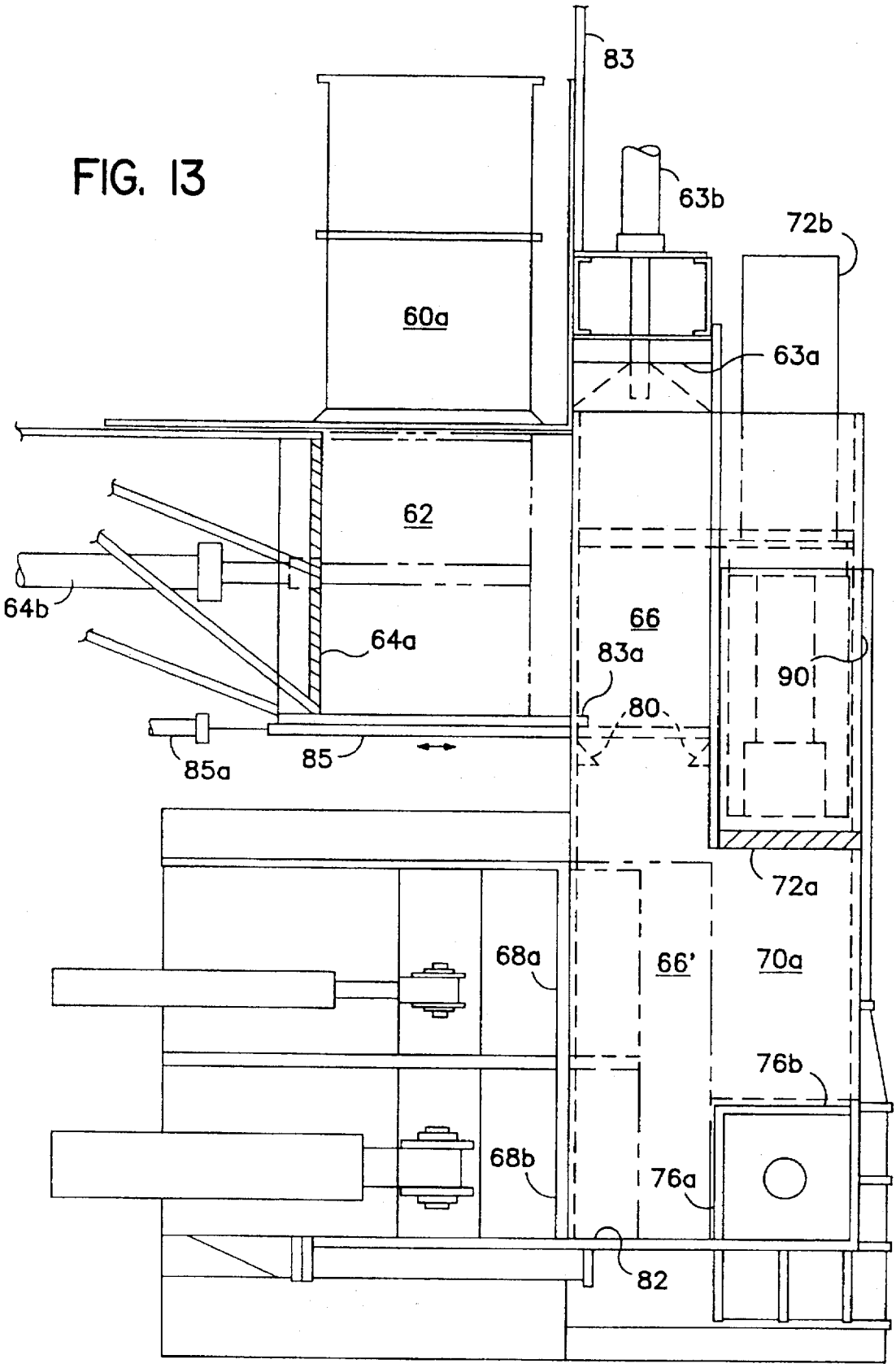
Figure 20:
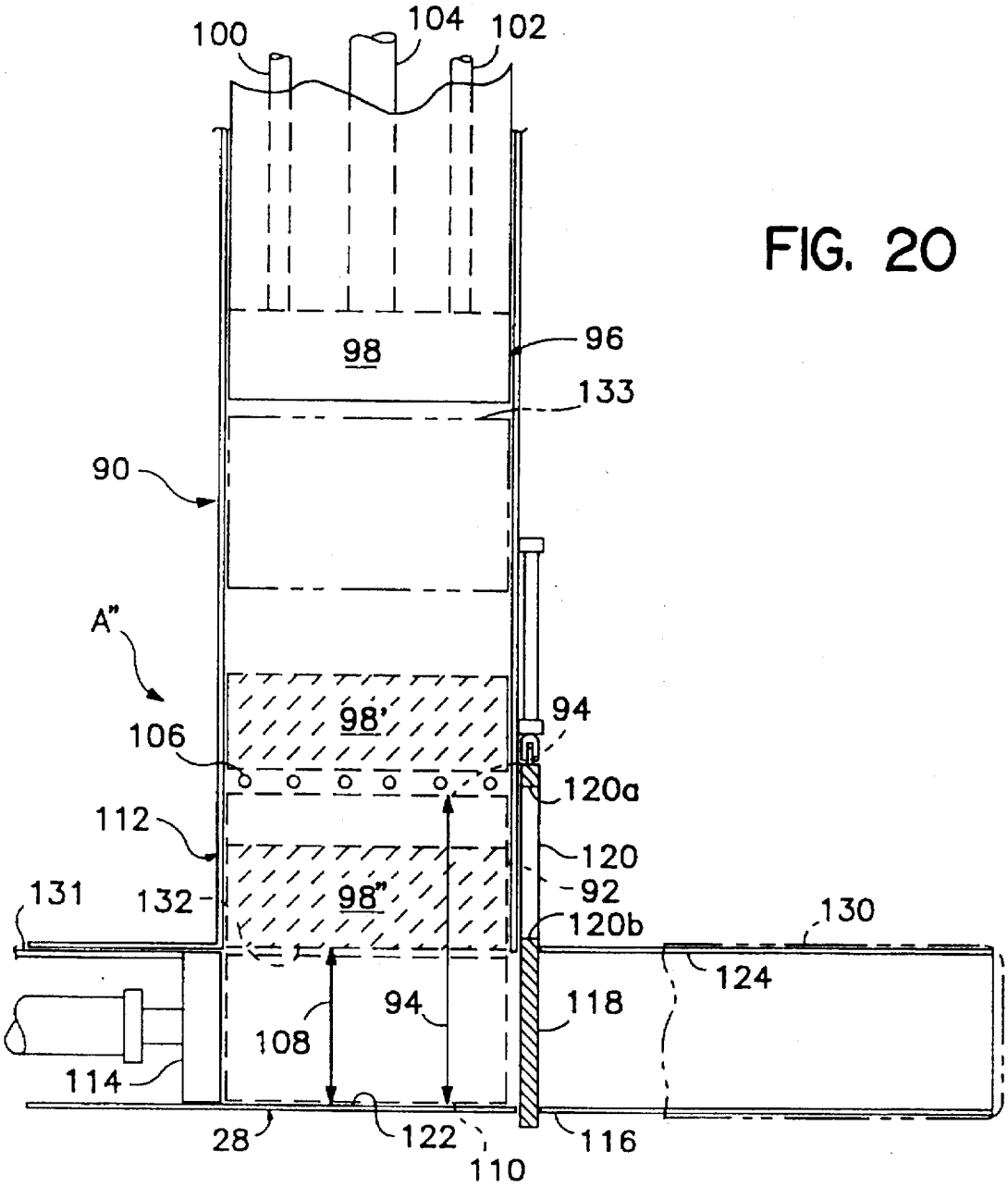
Figure 21:
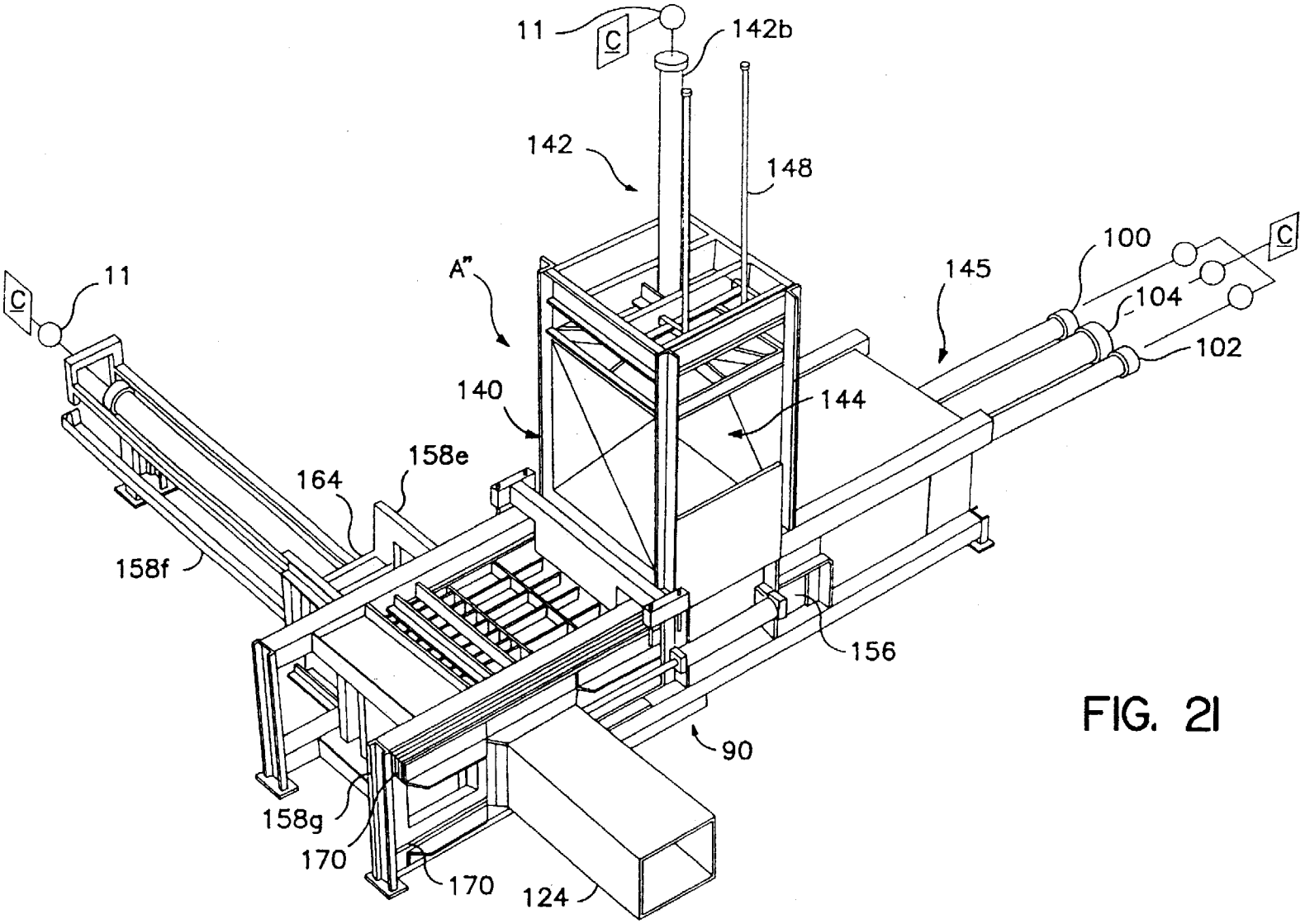
Figure 22:
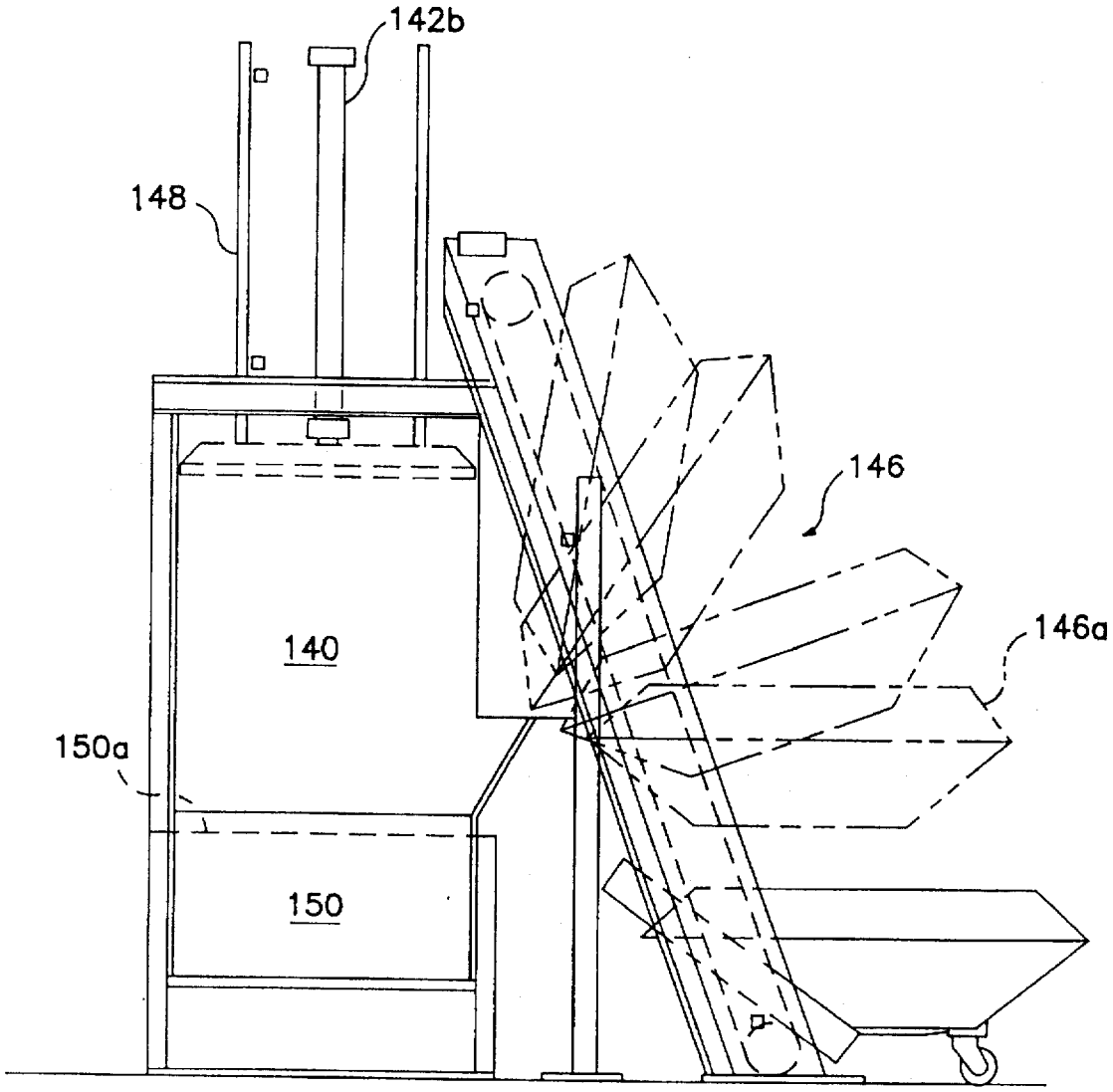
Figure 23:
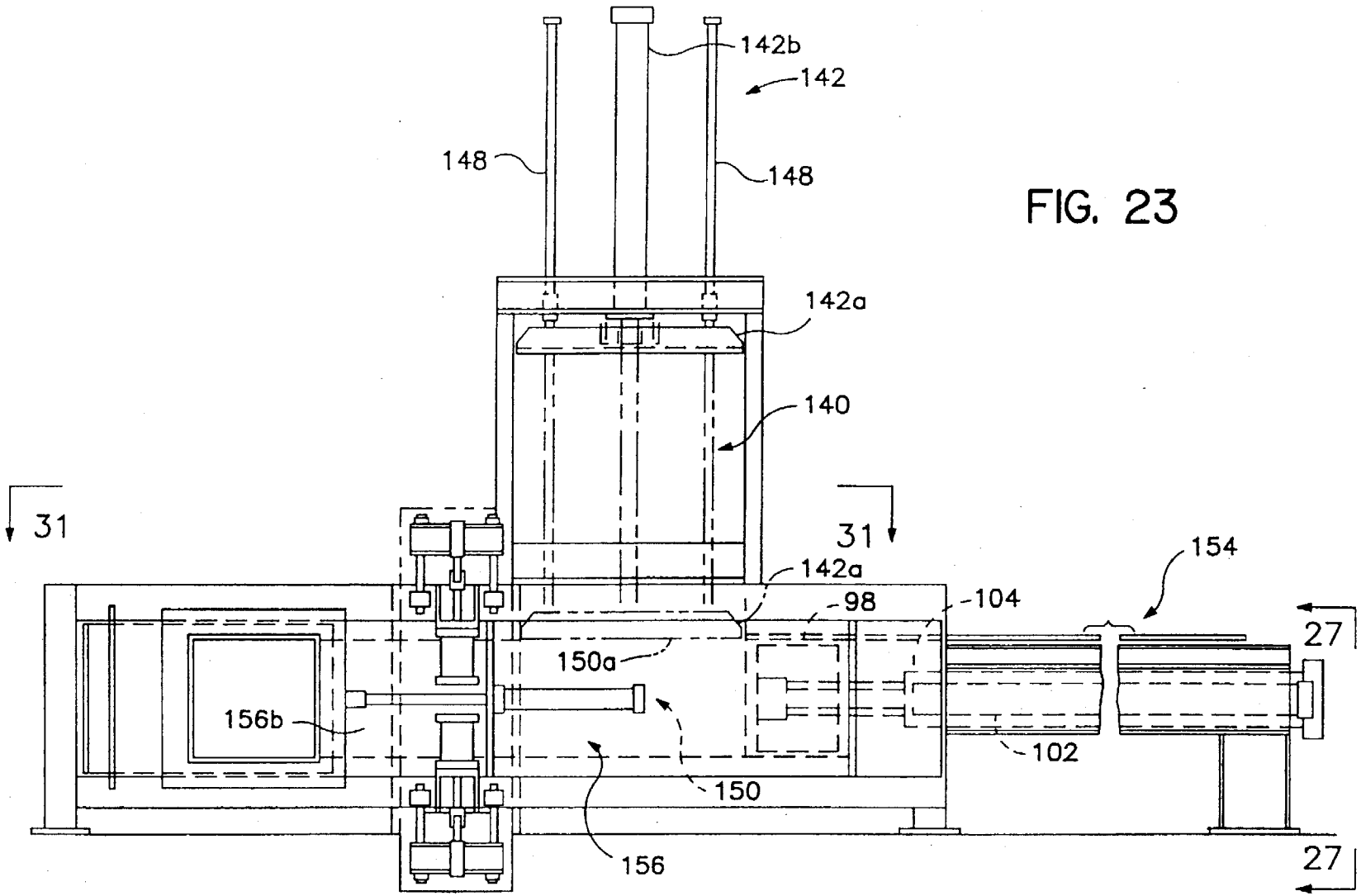
Figure 24:
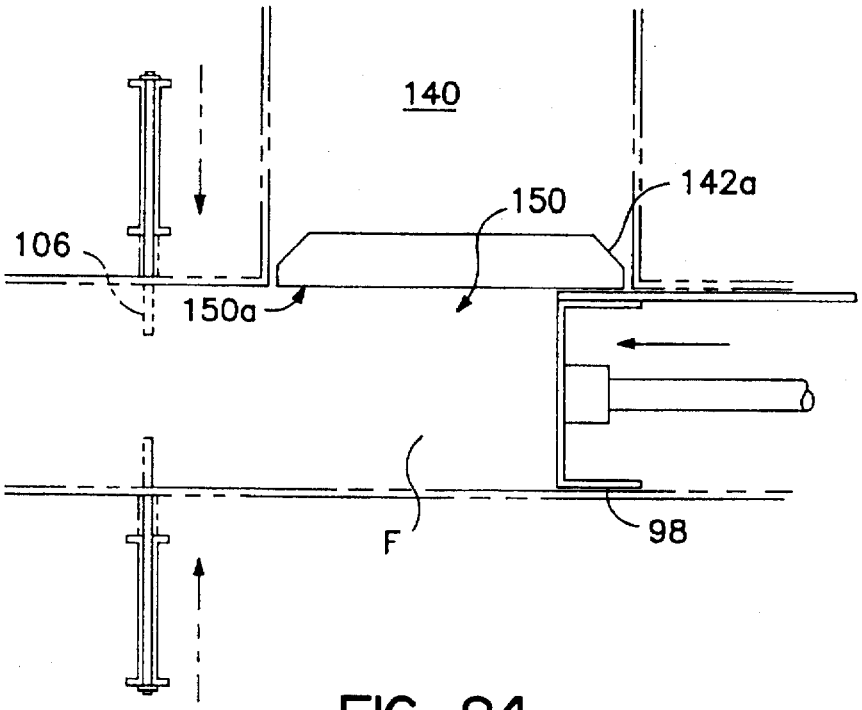
Figure 25:
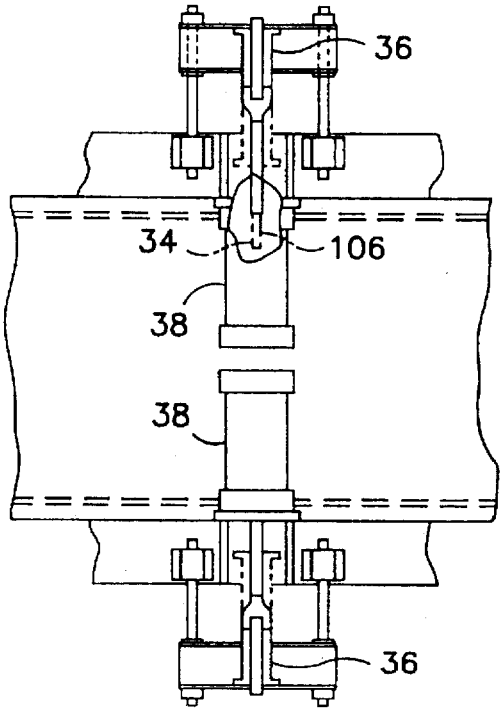
Figure 26:
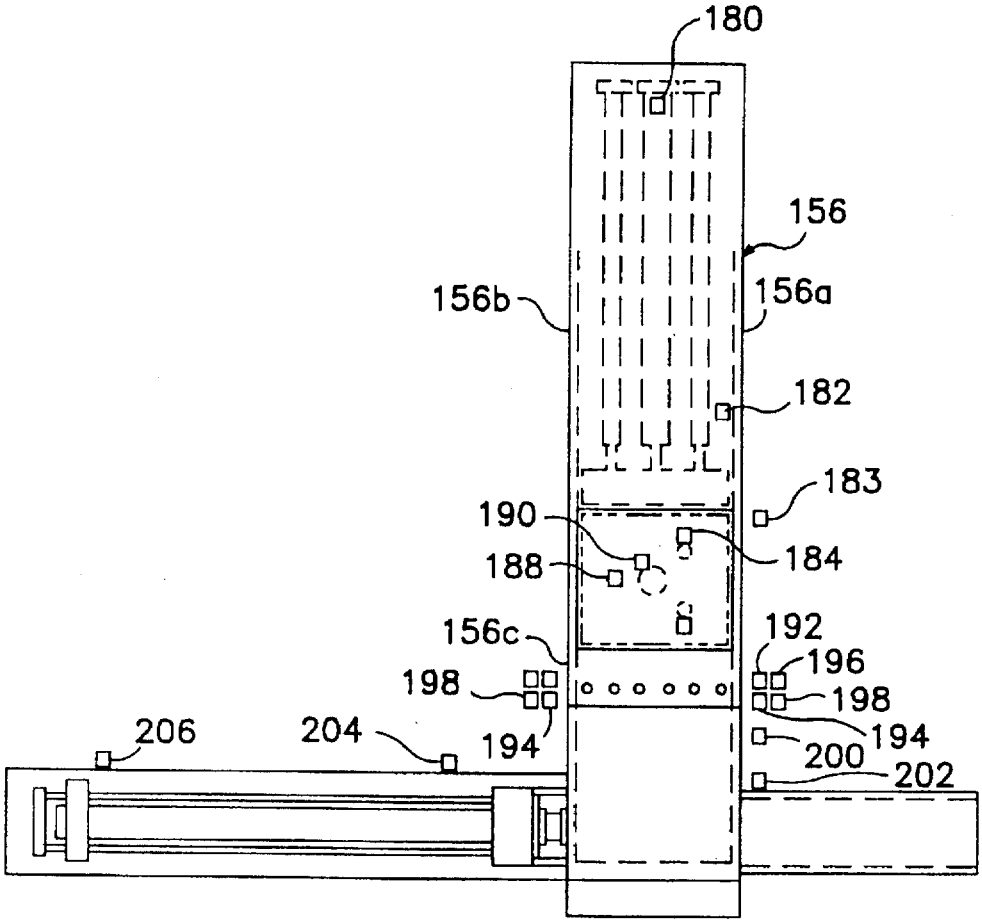
Figure 27:
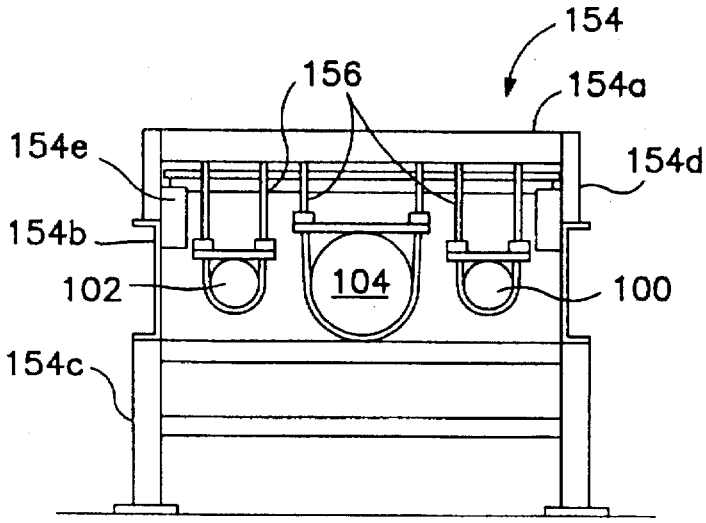
Figure 28:
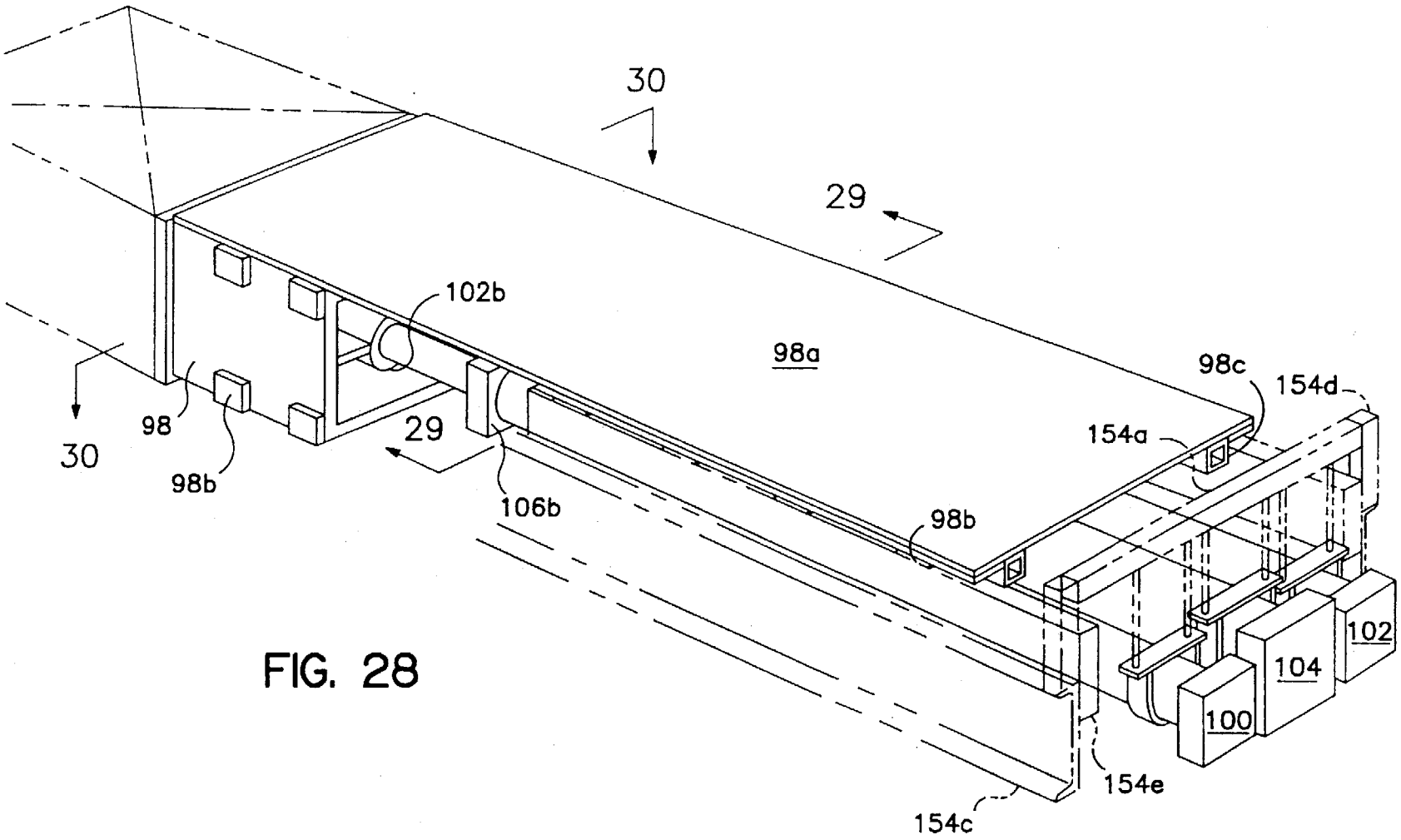
Figure 29:
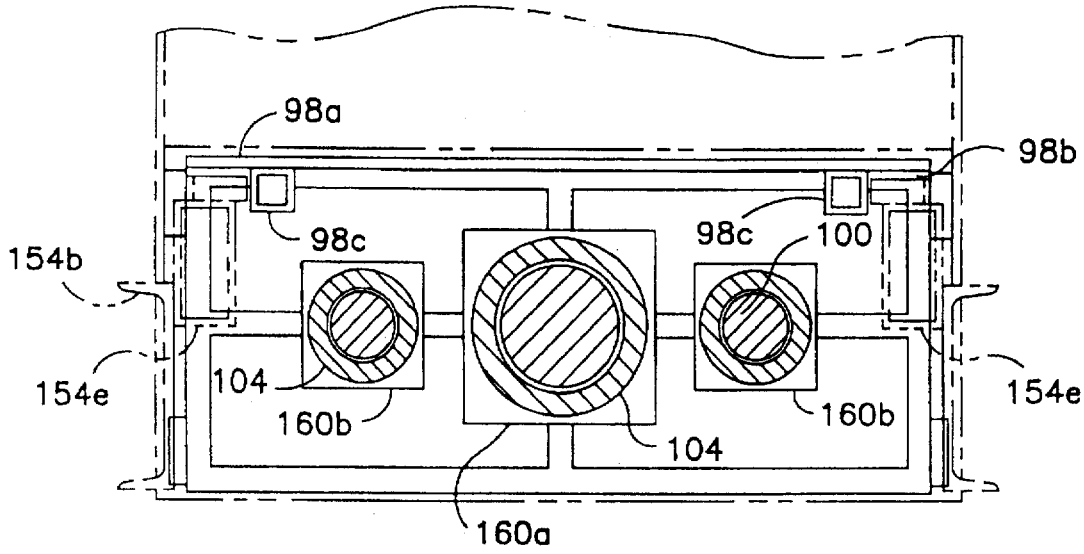
Figure 30:
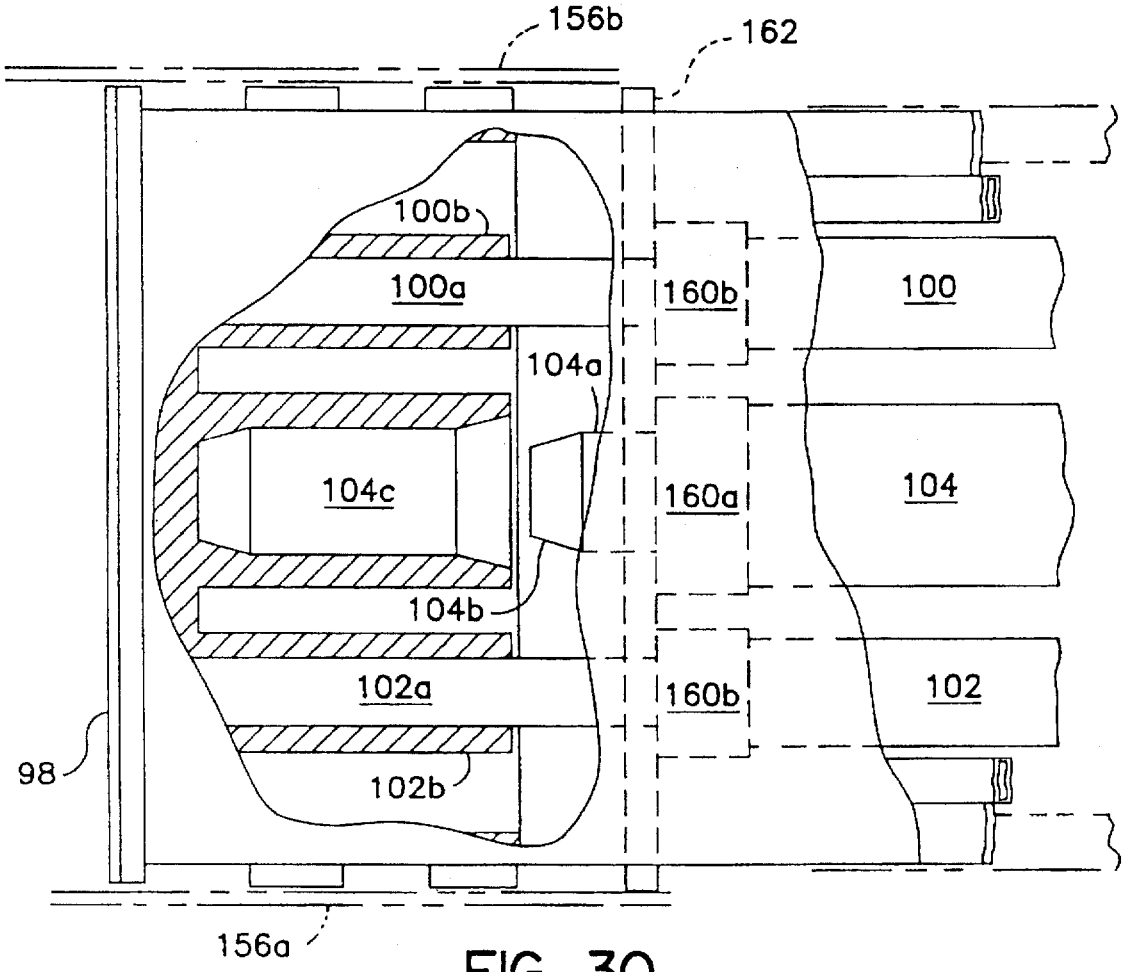
Figure 31:
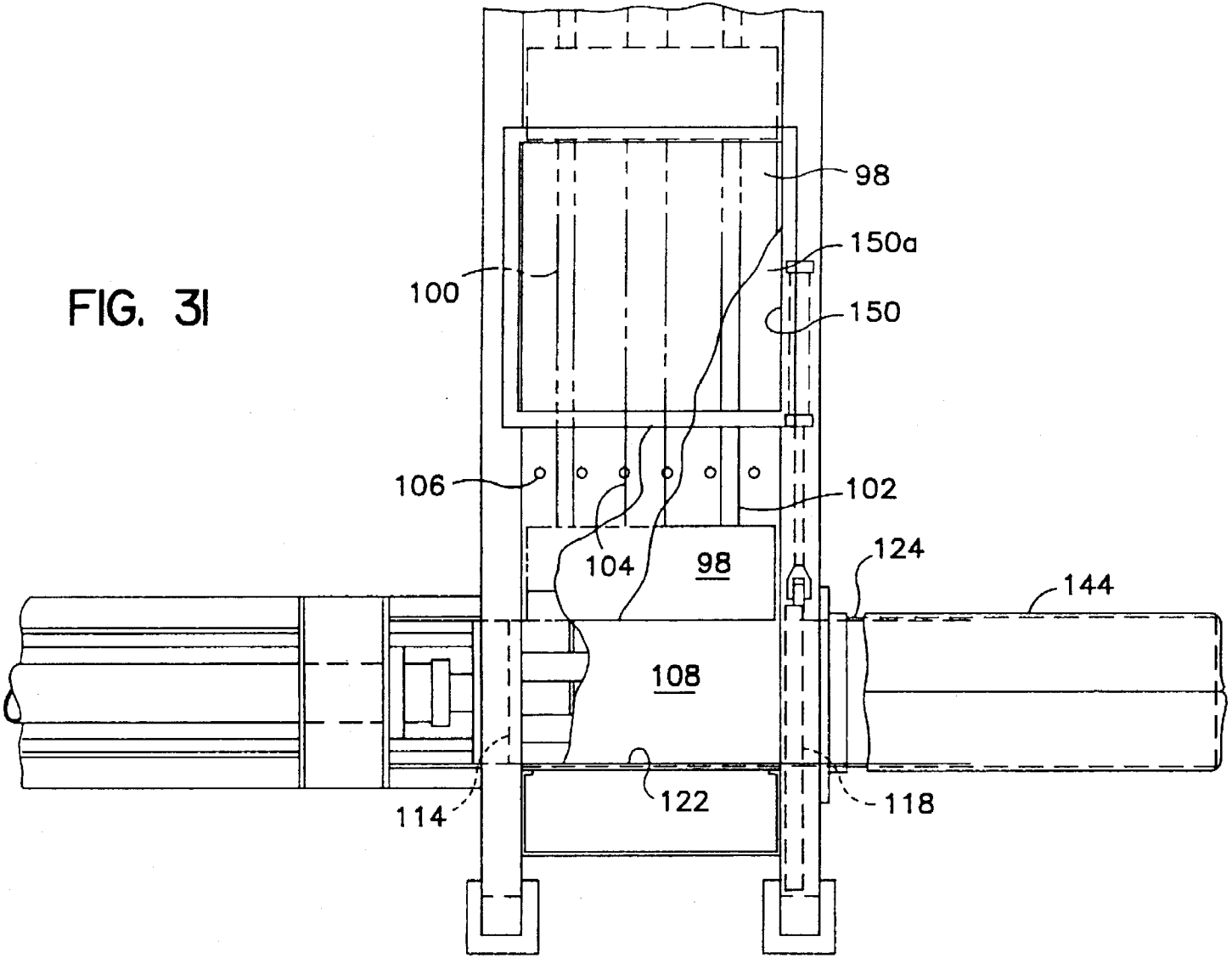
Figure 32:
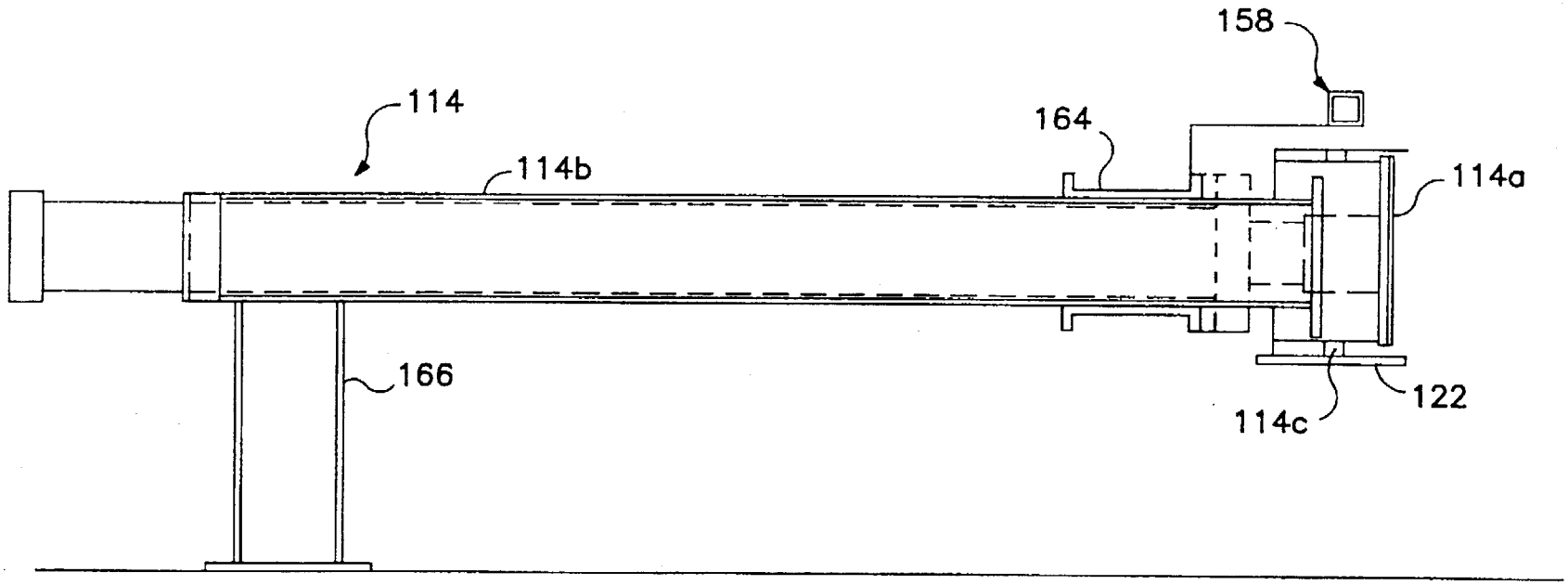
Figure 33:
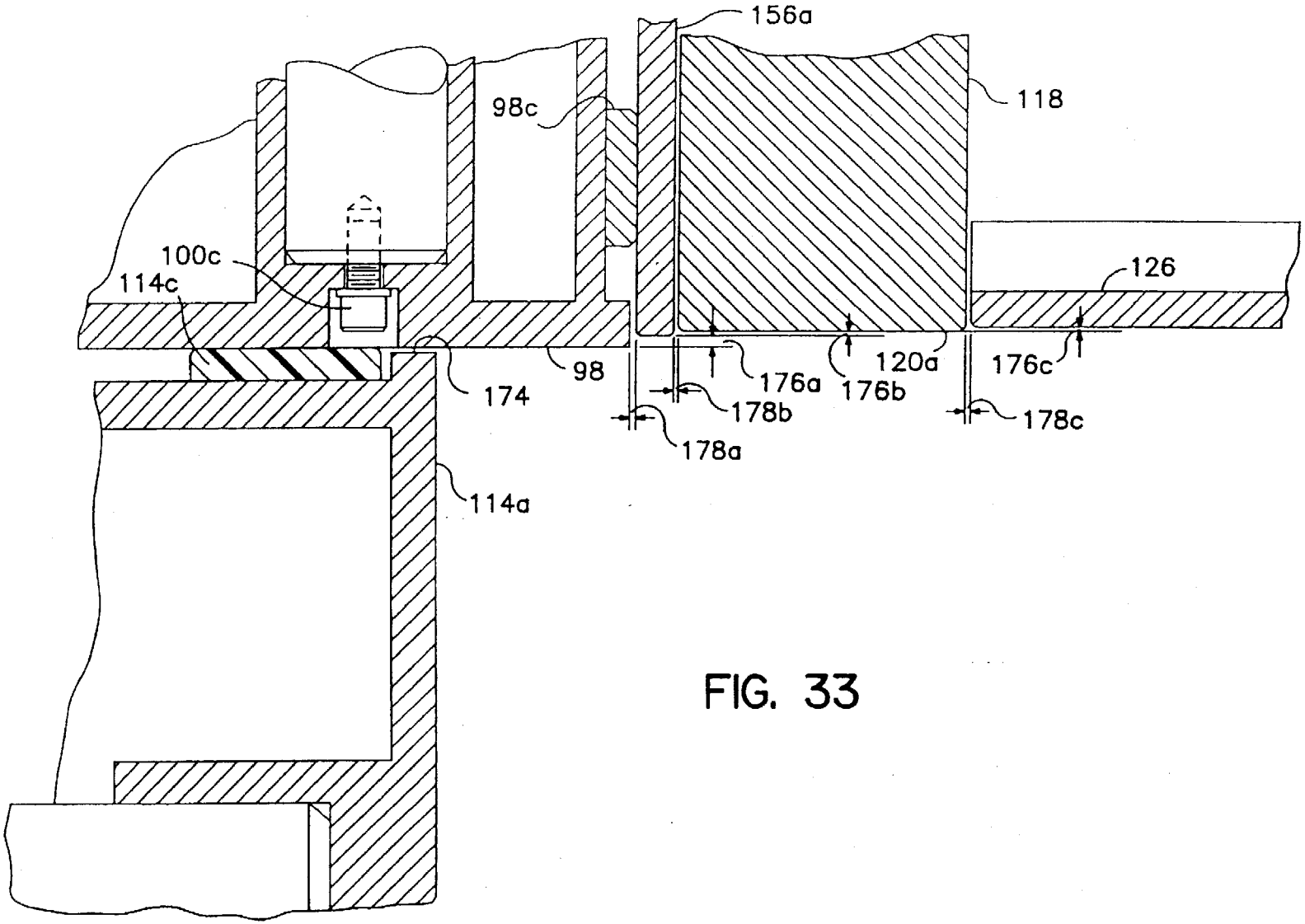
Figure 34:
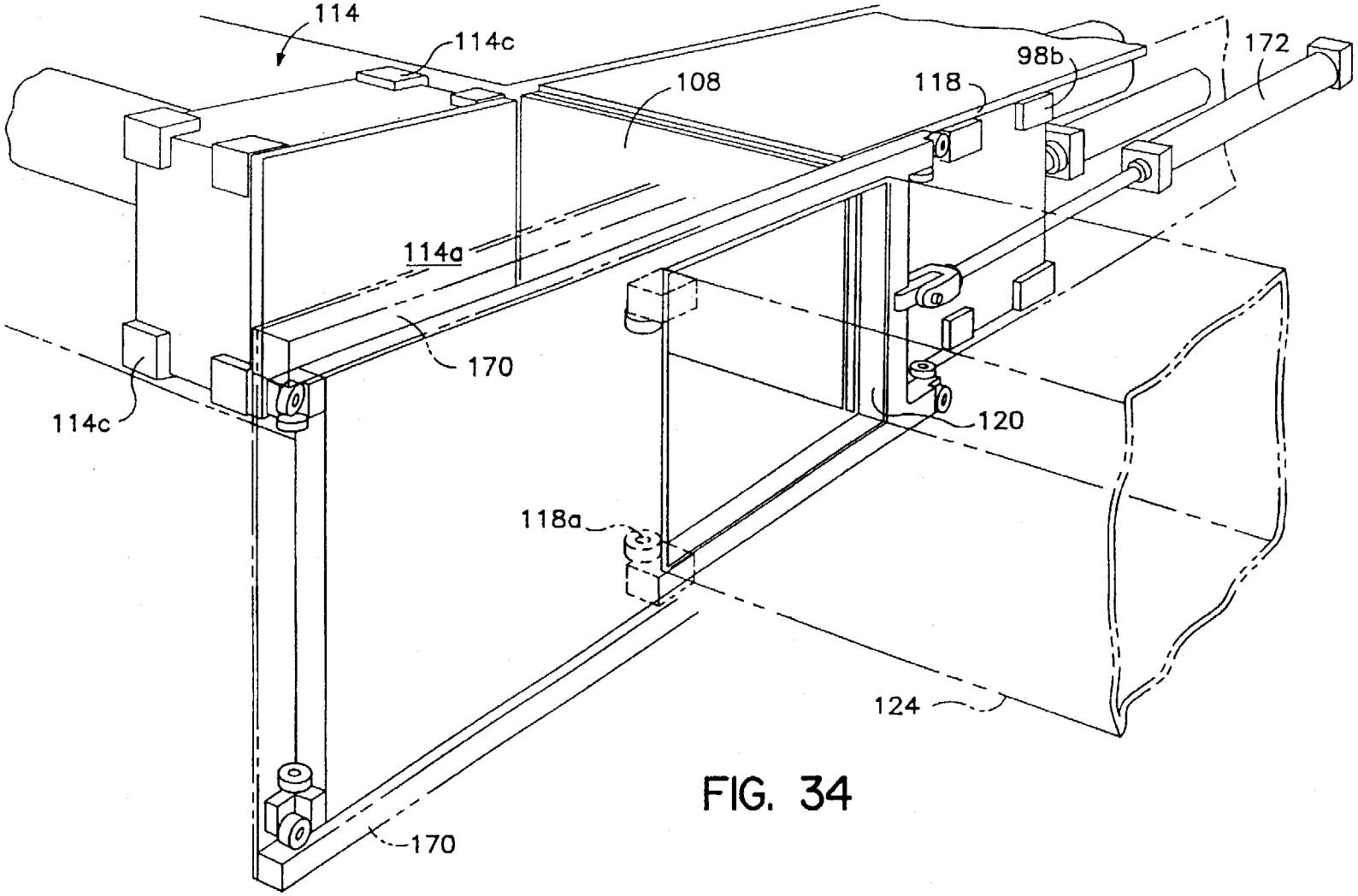

FIG. **4*a*** is a perspective view of a bale of compressible fibers produced in accordance with the apparatus and method of the present invention;

FIGS. 5–11 are schematic illustrations of the various processing chambers and supply, tramping, compression, and ejection cycles of an apparatus and method for producing strapless bales of compressible fibers according to the invention;

FIG. 12 is an alternate embodiment of an apparatus and method for producing strapless bales of compressible fibers according to the invention wherein an ejection sleeve for ejecting compressible blocks of fibers and forming said strapless bale is rotated ninety degrees from the embodiment of FIG. 1 as well as incorporating other changes;

FIG. 13 is a schematic elevation illustrating the various fiber processing chambers incorporating movable platens and plates for processing the fibers in accordance with the embodiment of FIG. 12;

FIG. **13*a* is a schematic elevation along the side of the ejection sleeve of the embodiment of FIG. 12**;

FIGS. 14–19 are perspective, schematic illustrations illustrating the various processing stages and cycles for producing a strapless bale of compressible fibers in accordance with the embodiment of FIG. 12 in accordance with the invention;

FIG. 20 is a schematic view of another embodiment of an apparatus and method for producing strapless bales of compressible fibers wherein a tramping and compression chamber are in axial alignment but transverse to an ejection sleeve;

FIG. 21 is a perspective view of an apparatus and method for producing strapless bales of compressible fibers employing the principles illustrated in FIG. 20 in a strapless baler arranged in a horizontal configuration;

FIG. 22 is an elevation illustrating the dumping and supplying of loose fibers to the strapless baler of FIG. 21;

FIG. 23 is a side elevation illustrating the strapless baler of FIG. 21 emphasizing the filling chamber, tramping chamber, and compression chamber, and ram assembly therefor;

FIG. 24 is a schematic elevation illustrating the forward stroke of the ram assembly at the commencement of a tramping cycle;

FIG. 25 is an enlarged view of fiber retaining elements for retaining tramped fibers upon the retraction stroke of the ram assembly;

FIG. 26 is a schematic top plan view illustrating the strapless baler of FIG. 21 and the location of proximity switches for controlling the ram assemblies during tramping, compression, and ejection;

FIG. 27 is an end view taken along Line 27—27 of FIG. 23;

FIG. 28 is a perspective view illustrating the main ram assembly of the horizontal strapless baler of FIG. 1 and movable shelf door which closes the tramping chamber opening during the tramping cycle so that filling operations may continue;

FIG. 29 is a sectional view taken along Line 29—29 of FIG. 28;

FIG. 30 is a sectional view taken along Line 30—30 of FIG. 28;

FIG. 31 is a top plan view illustrating a compaction chamber opening which is closed by a movable shelf door carried with a platen assembly for tramping and compressing fibers, and the ejection section of the apparatus and method;

FIG. 32 is a side elevation illustrating the ejector section of a horizontal strapless baler according to the invention;

FIG. 33 is a plan view taken in section of a compression chamber and ejection sleeve configuration for ejecting a compressible block of fibers for forming a strapless bale according to the invention wherein off-sets provide relief for ejecting the compressible block of fibers;

FIG. 34 is an enlarged perspective view illustrating a rolling ejection door assembly having an opening which aligns with the ejection sleeve during an ejection cycle of which a compressible block of fibers is ejected from a compression chamber for expansion into a flexible bag wherein the door opening is off-set on one edge for relief of compression during ejection; and FIGS. 35–40 are schematic elevations illustrating the various processing stages, chambers, and cycles for producing a strapless bale of compressible fibers with the apparatus and method shown in FIG. 20 as applied to the tramping and compression chambers being aligned either horizontally or vertically.

DESCRIPTION OF A PREFERRED EMBODIMENT

Referring now in more detail to the drawings, a method and apparatus for producing a strapless bale of compressed fibers is illustrated wherein loose fibers are supplied to a tramping chamber wherein the loose fibers are compacted into a fiber mass. Next, the fiber mass is compressed in a compression chamber in the same direction that the fiber mass is tramped to produce a compressed fiber block. Afterwards, the compressed fiber block is ejected from a compression chamber through an ejection sleeve having a rectangular cross-section wherein ejection takes place in a transverse direction to the direction of the compression. A flexible bag having a cross-section greater than the cross-section of the ejection sleeve is draped over the ejection sleeve. The compressed fiber block is subjected to an expansion in the direction of compression as it moves into the flexible bag where the increased area of the flexible bag accommodates the rebound forces of the compressed fibers without bursting whereby a strapless fiber bale of compressed fibers is produced.

As can best be seen in FIG. 1, an embodiment of the invention is illustrated wherein a strapless fiber baler, designated generally as A, is illustrated which includes a supply chamber, designated generally as 10 and a fiber pusher section designated generally as 12. Loose fibers F are conveyed to supply chamber 10 by any suitable pneumatic conveyor illustrated at 14. Loose fibers from the fiber pusher chamber are pushed into a tramping chamber, designated generally as 16. In the tramping chamber, the loose fibers are formed into a compacted fiber mass by a tramper assembly, designated generally as 18. The compacted fiber mass is received in a compression chamber, designated generally as 20, where the compacted fiber mass is compressed into a fiber block by a main ram assembly, designated generally as 22. Finally, the compressed fiber block is ejected in a transverse direction from a lower compression chamber section 24*a* through an ejection sleeve, designated generally as 26, by an ejector platen assembly, designated generally as 28.

Figure 2:
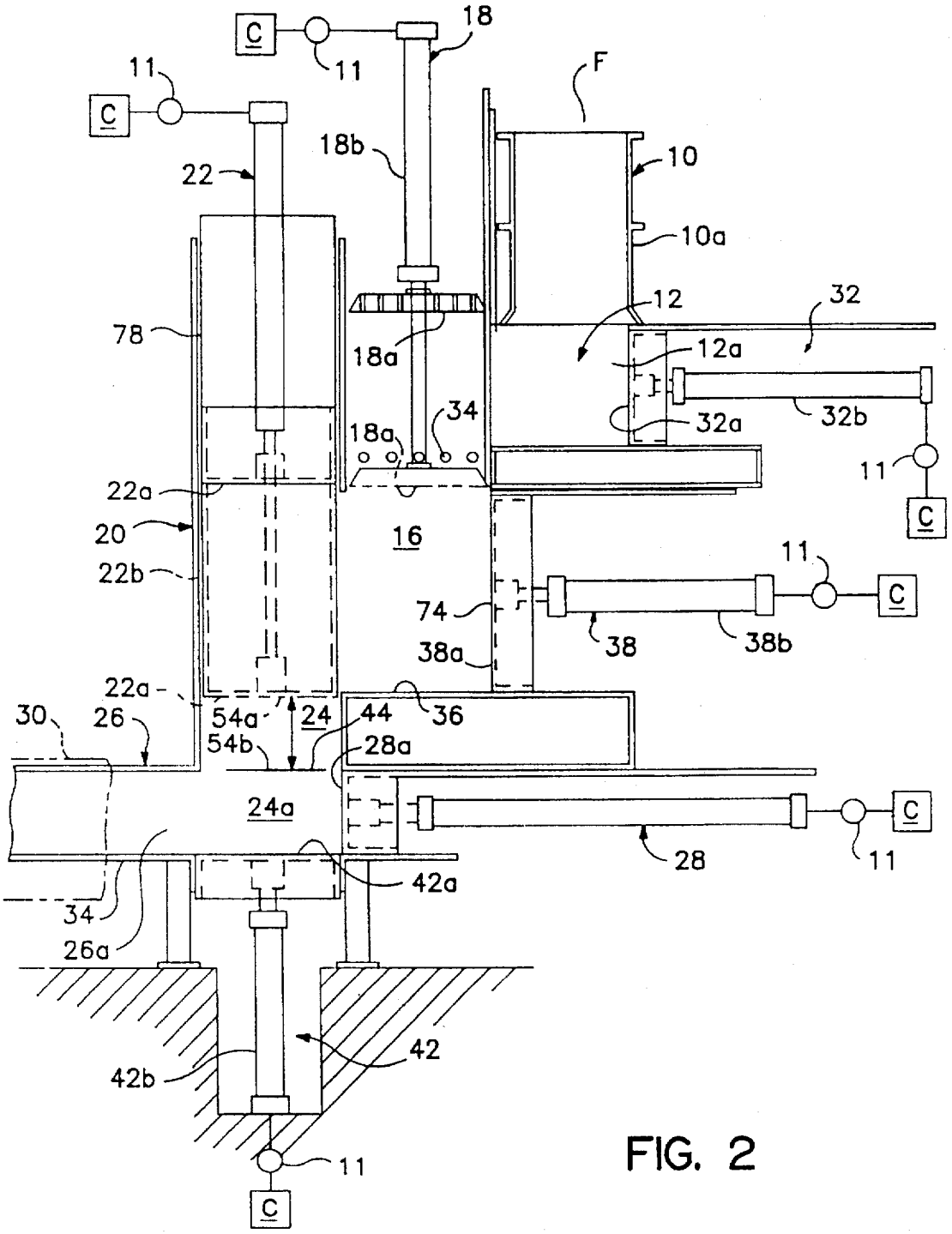
FIG. 2 is a schematic side elevation illustrating the internal processing chambers of an apparatus and method for producing strapless bales of compressible fibers as shown in FIG. 1.
Figure 3:
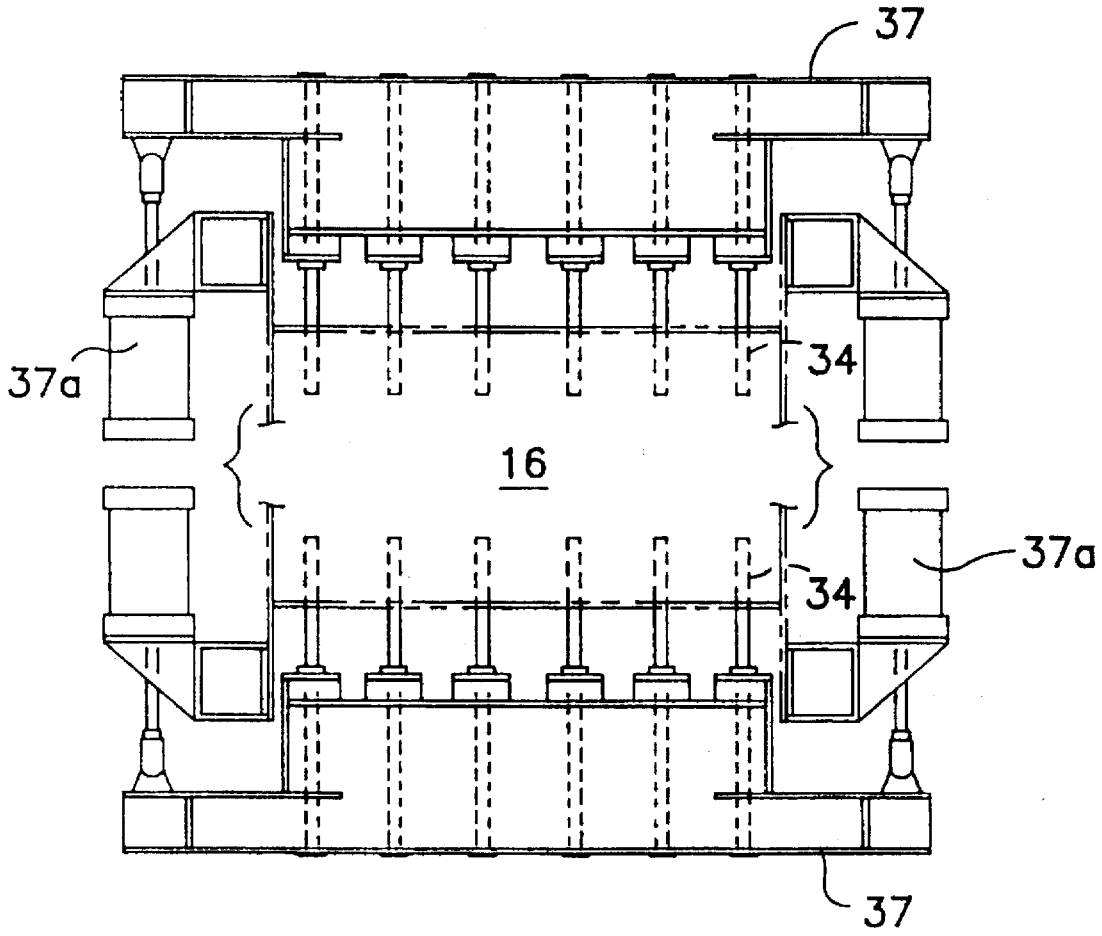
FIG. 3 is a section view taken along Line 3—3 of FIG. 1.

Referring now in more detail to FIG. 2, the method and apparatus will be more fully described, wherein loose fibers F pneumatically conveyed or by gravity, are deposited in a condenser, or air separation unit, having a screen section 10*a* from which air escapes as shown by the arrows to deposit the loose fibers into chamber 12 where they are pushed forward into tramping chamber 16 by means of a fiber pusher assembly, designated generally as 32, which includes a fiber pusher plate 32*a* and a ram cylinder 32*b* connected to a suitable source of hydraulic fluid by which the ram is actuated. Fibers are pushed into the tramping chamber 16 which includes a plurality of fiber retaining elements 34 (FIG. 3) which retain the fibers after being pushed past the retaining elements by a tramping plate 18*a*, such as a webbed tramping foot or platen, having a slot opening to relieve the air on the tramping stroke, which forms part of the tramping assembly 18. Plate 18*a* is reciprocated by a tramping ram cylinder 18*b* connected to a suitable source of hydraulic fluid by which it is actuated. An effective tramping chamber is defined between retaining elements 34 and an opposing wall 36 in which the fibers are formed into a compacted fiber mass. Successive deposits of loose fibers will be pushed into the tramping chamber and tramped by plate 18*a* until a compacted fiber mass having a prescribed amount of fibers, or a prescribed weight, is formed. For these purposes, fiber retaining elements 34 may be provided in the form of a plurality of dogs 34 carried on opposing sides of the tramping section as can best be seen in FIG. 3 wherein a plurality of dogs 34 are carried on rails 37 and reciprocated in and out of the chamber by means of hydraulic or air actuators 37*a*. The extension and retraction of the dogs into and out of the chamber may be controlled in a conventional manner so that the dogs are retracted when the tramping plate is extended, and the dogs are extended when the tramping plate has been retracted past the dogs.

Figure 5:
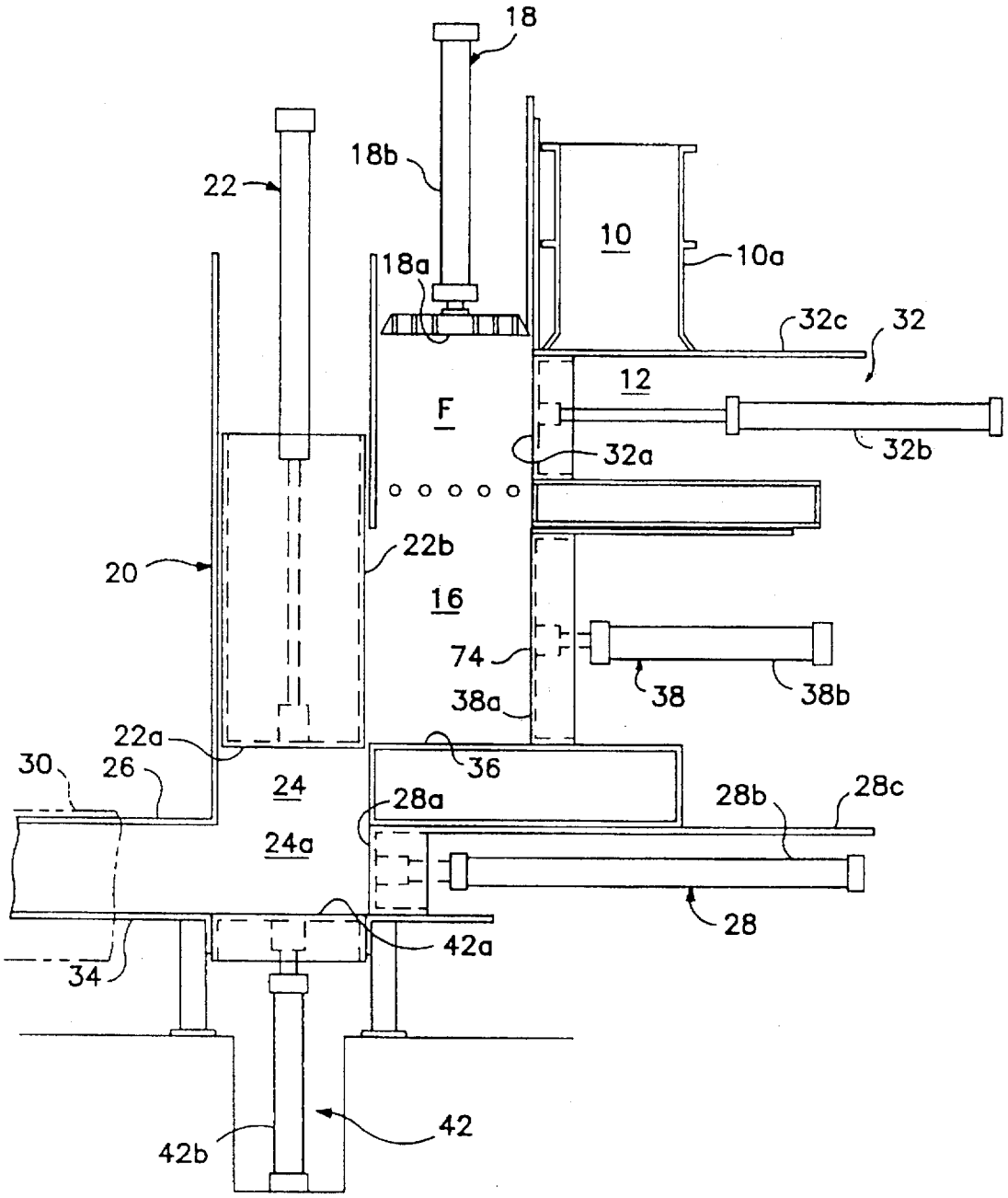
Figure 6:
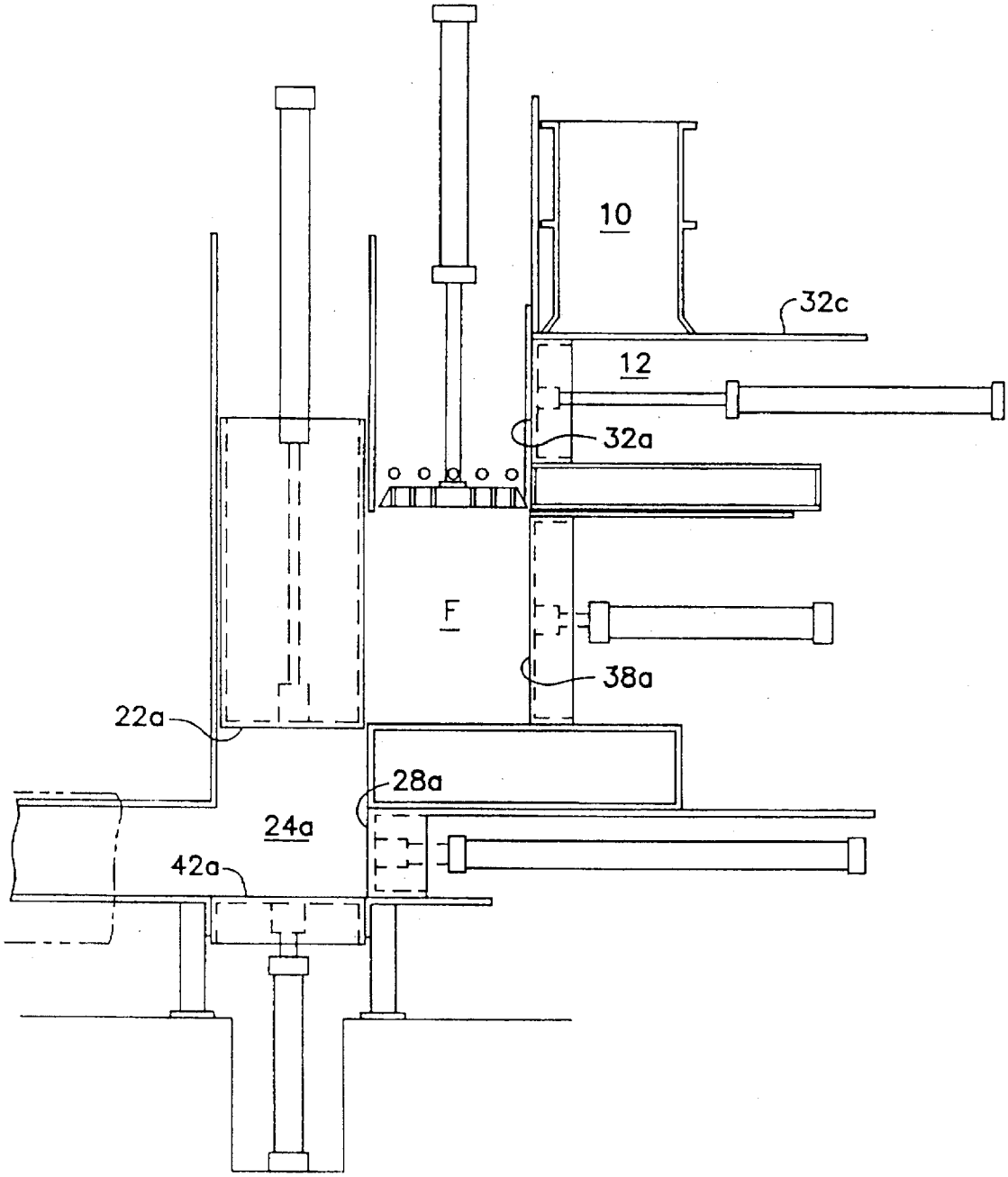

After the compacted fiber mass is formed containing the prescribed amount of fibers, a transfer plate assembly 38 is actuated so that a transfer plate 38*a* is moved to the left by a ram cylinder 38*b* to transfer the fiber mass into compression section 24. During the supply and tramping cycles, it is noted that the supply and tramping of fibers in chamber 16, it is noted that a platen 22*a* of main platen assembly 22 is moved to a position adjacent bottom wall 36 of the tramping chamber so that a rectangular shroud 22*b* which forms part of the platen assembly, acts as a wall of the tramping chamber (FIGS. 5 and 6). The opposing wall is provided by transfer plate 38*a*, and the remaining side walls are provided by stationary side plates of a unitary frame which completes the enclosure. During the transfer cycle, tramping plate 18a is extended to the position shown in FIG. 7 to form a top of the tramping/transfer chamber. The tramping plate has a home position shown in solid lines in FIG. 2.

Figure 8:
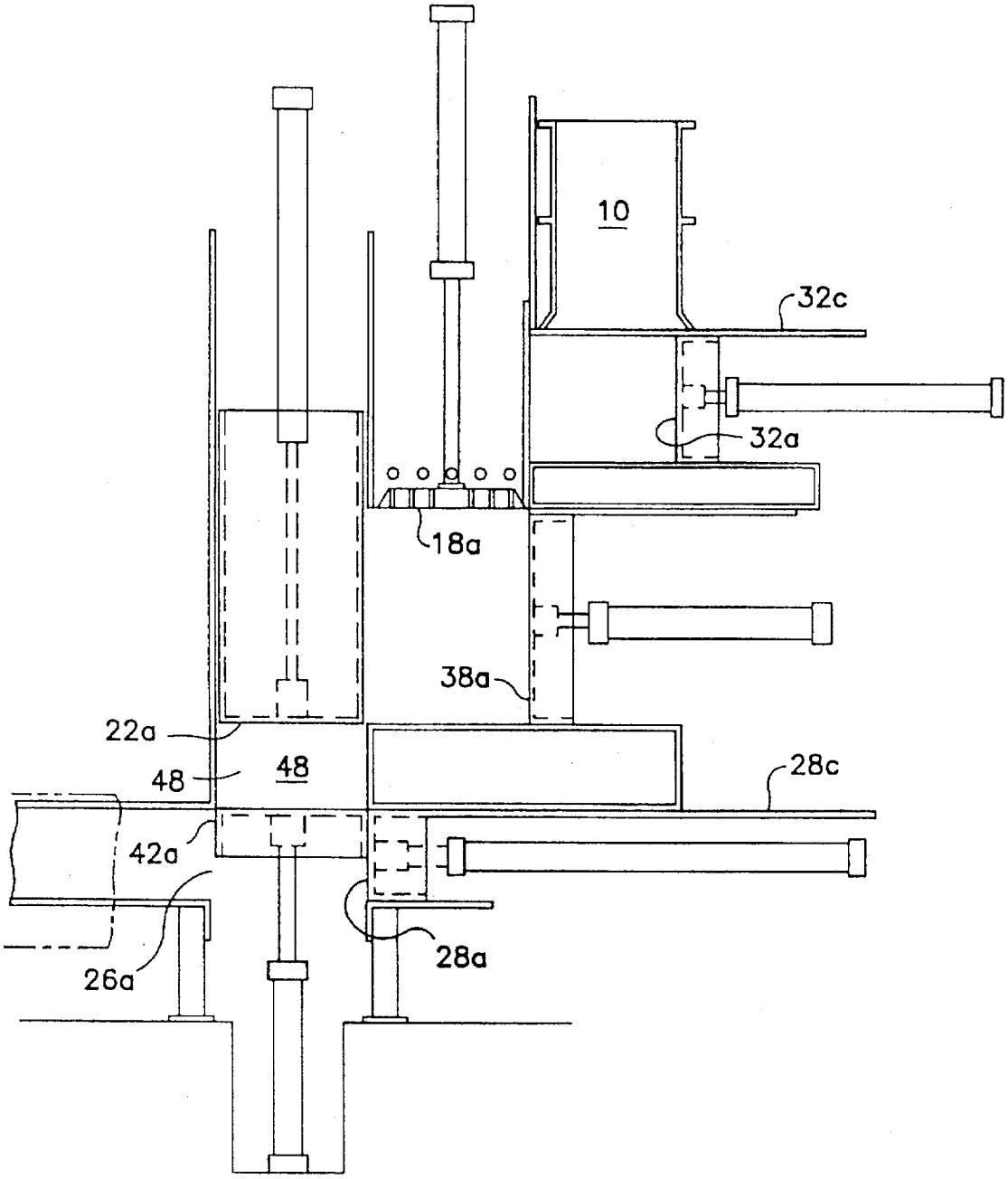
Figure 9:
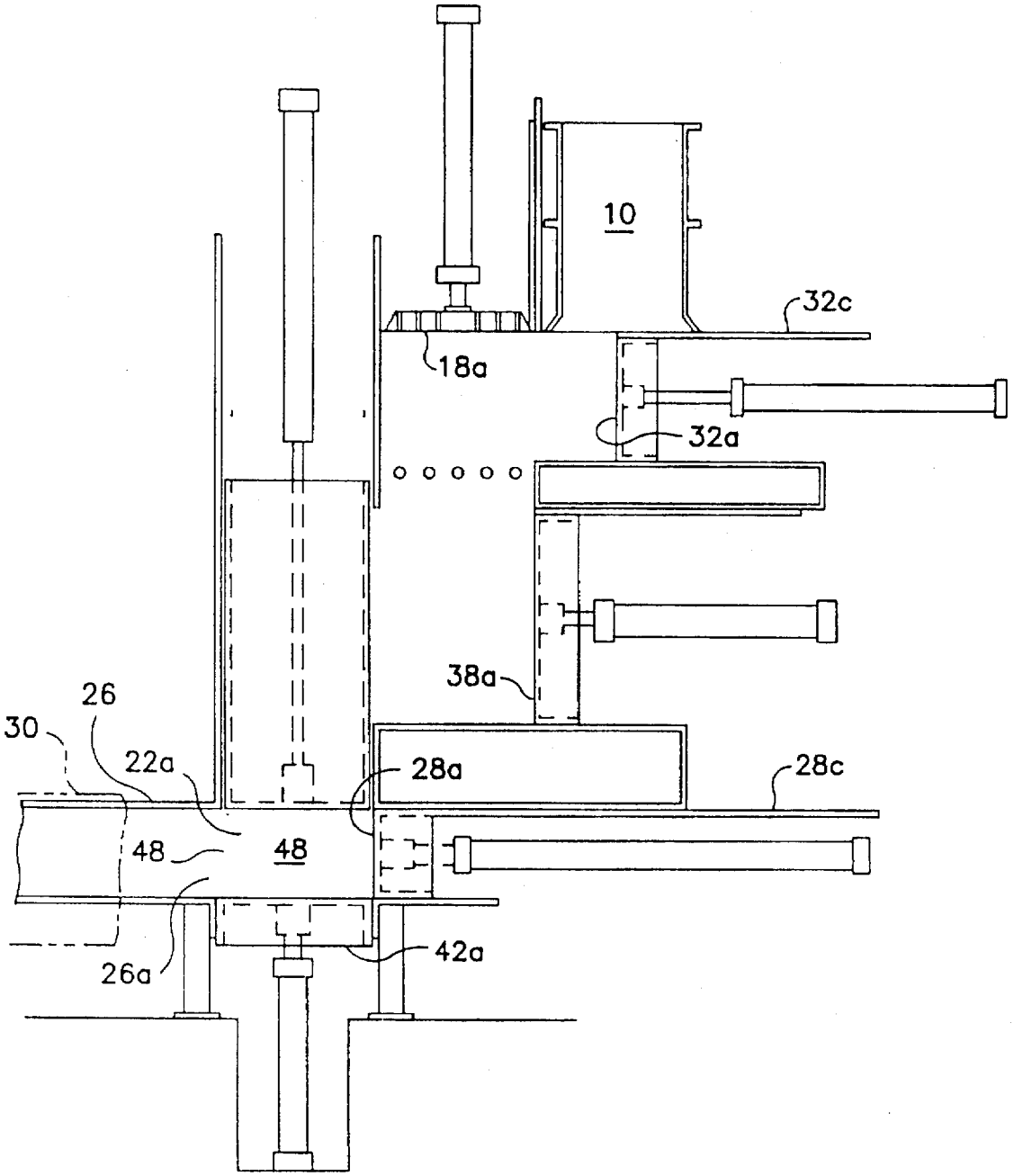

Compression chamber 20 includes a compression sections 24, and an injection section 24a above and adjacent ejection sleeve 26, respectively. The bottom of the compression chamber is provided by a movable bottom or secondary platen assembly, designated generally as 42, which includes a movable bottom platen 42a and a bottom ram cylinder 42b connected to a suitable source of hydraulic fluid for actuation. Compression section 24 is defined by lines 54a and 54b which also define compression positions for main platen 22a and secondary platen 42a, as will be discussed in their operation. The use of two movable platens in the compression chamber and ejection sleeve eliminates the need for an ejection sleeve door required in the embodiments of FIGS. 12, 20, and 21. This is due to the fact that the fiber mass is compressed in compression section 24, and the platens 22a, 42a positively hold the compressed block after compression and transfer the fiber block into registry with an ejection opening 26a of ejection sleeve 26 so that no door is needed (FIG. 8 and 9). This concept may be employed in horizontal and vertical arrangements, and in the embodiments of FIGS. 12 and 20. However, the concept requires an additional moving platen and assembly, but is advantageous in some applications due to the complexity of a rolling ejector door assembly and actuation. Ejector assembly 28 includes an ejector platen 28a and an ejector ram cylinder 28b connected to a suitable source of hydraulic fluid for actuation. A door shelf 28c is affixed to ejector platen 28a and reciprocates with the platen for closing a compression chamber opening 44 during the ejection cycle. Occasionally, if an over fill occurs, extension of ejector platen 28 may shear fibers from the compression face of the fiber block. Door shelf 28c prevents those fibers from falling behind the platen, and their inclusion in the next bale. As will be explained more fully in the description of the method and operation, main platen plate 22a forms a top wall of injection section 24a during the ejection cycle. However, so that the supply and tramping cycles may continue during the ejection cycle, it is desired that main platen plate 22a return to position 54a in FIG. 2 once the ejector platen closes off opening 44. Main platen 22a is retracted to its home position only at the beginning of a transfer cycle when fiber mass F' is being transferred to the compression chamber.

It will be understood that the various chambers so described are rectangular and that the remaining portions of the enclosures not described, will, in addition, to the described movable plates and platens be apparent to those skilled in the art having been taught the expedients of the invention. A unitary frame, designated generally as 29, is provided for supporting and including the various extension sides and bottom plates needed to finish the enclosures, and the various movable platens and plates. Among other like members, the unitary frame includes various vertical and horizontal frame legs 29a, 29b. Various outer walls or plates generally include supply chamber outer walls 29c, transfer chamber outer walls 29d, tramping chamber outer walls 29e, compression chamber outer walls 29f, and ejector assembly outer walls 29g.

Figure 4:
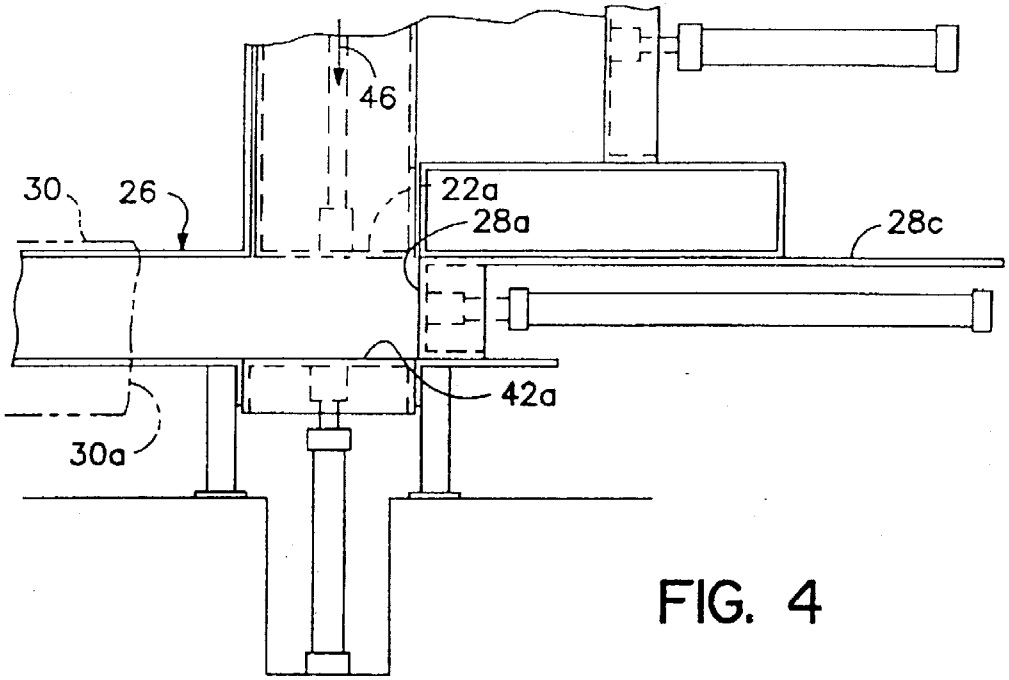
FIGS. 4, **4*b* are respective side and end elevations of an ejection section of the strapless baler of FIG. 1** illustrating the ejection of a compressed fiber block and expansion into a flexible bag for forming a bale of compressible fibers according to the invention.
Figure 4B:
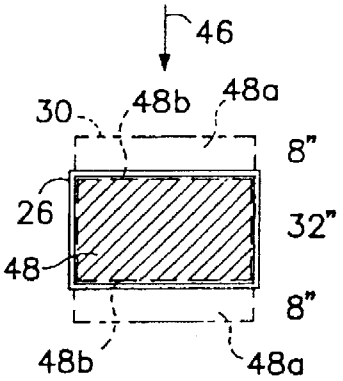
Figure 4A:
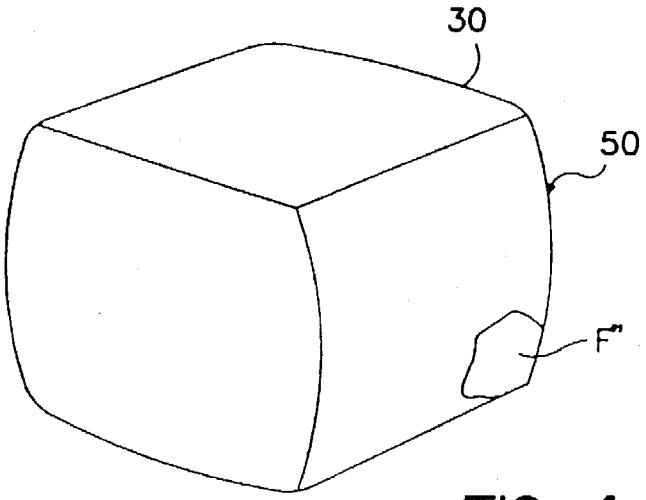

Having had an understanding of the various chambers in which the fibers are processed, and the various movable plates and platens which process the fibers, the operation and method of the present invention will now be described in more detail. First, referring to FIG. 4, an example of a compressed fiber bale 50, approximately forty-eight inches square, made in accordance with the invention will be referred to. While the dimensions of the various rectangular chambers and ejection sleeve may vary, one embodiment is illustrated in FIG. 4 for purposes of illustration and example. In the illustrated embodiment of FIG. 4, ejection sleeve 26, for example, has an interior height of thirty-two inches and a width of approximately forty-eight inches. Flexible bag 30 is fitted over the sleeve and its mouth at 30a may be retained with a band or other suitable means, or it may be left free, depending on the application being made. In either case, as mentioned previously, flexible bag 30 has a significantly greater cross-section than that of the ejection sleeve, which is illustrated in FIG. 4b. Flexible bag 30 is preferably a woven, seamless bag woven from polypropelene or other suitable material having a high strength. The bag is seamless and includes open mouth 30a. Flexible bag 30 will have an overall dimension or cross-section illustrated by the dotted lines in FIG. 4b. The compressed fiber block 48 in the ejection sleeve has a dimension generally equal to thirty-two inches in height and forty-seven inches in width. However, as the compressed fiber block is ejected from the sleeve and enters the bag, it immediately expands due to the rebound pressure of the compressed fibers to fill the bag with fibers as shown in dotted lines at 48a. The fibers will expand mainly in the direction of compression shown by arrow 46. Accordingly, the compressed faces 48b of the fiber will expand into dotted line areas 48a. In practice, it has been found that the fibers will expand very little in the length and width directions, perhaps only one or two inches. Accordingly, upon ejection, a compressed fiber bale which includes the expanded fiber block in bag 30, noted generally as 50, is produced having dimensions generally equal to forty-eight inches in width, forty-eight inches in height, and about forty-eight inches in length. Thus, it can be seen that about a fifty-percent expansion has occurred in the bagged compressed block of fibers over the compressed bale of fibers present in the ejection sleeve. Accordingly, flexible bag 30 must be able to accommodate expansions while still retaining a tight, compressed bale of fibers.

Operation

Referring now to FIGS. 5 through 11, the operation and method of the above embodiment of the invention now be described in more detail. FIGS. 5 through 6 illustrate the supply and tramping cycles wherein loose fibers F are formed into a compacted fiber mass F'. During the supply and tramping cycles, main platen 22a is at its intermediate position, as shown. Successive deposits of fibers F are pushed from supply chamber 12 into tramping chamber 16 by pusher plate 32a (FIGS. 2 and 5). Next, tramper plate 18a compacts the fibers into compacted fiber mass F' (FIG. 6). Upon retraction of the tramping plate, the fibers are retained by dogs 34. The process is repeated until the desired quantity of fibers are obtained in compacted fiber mass F'.

Figure 7:
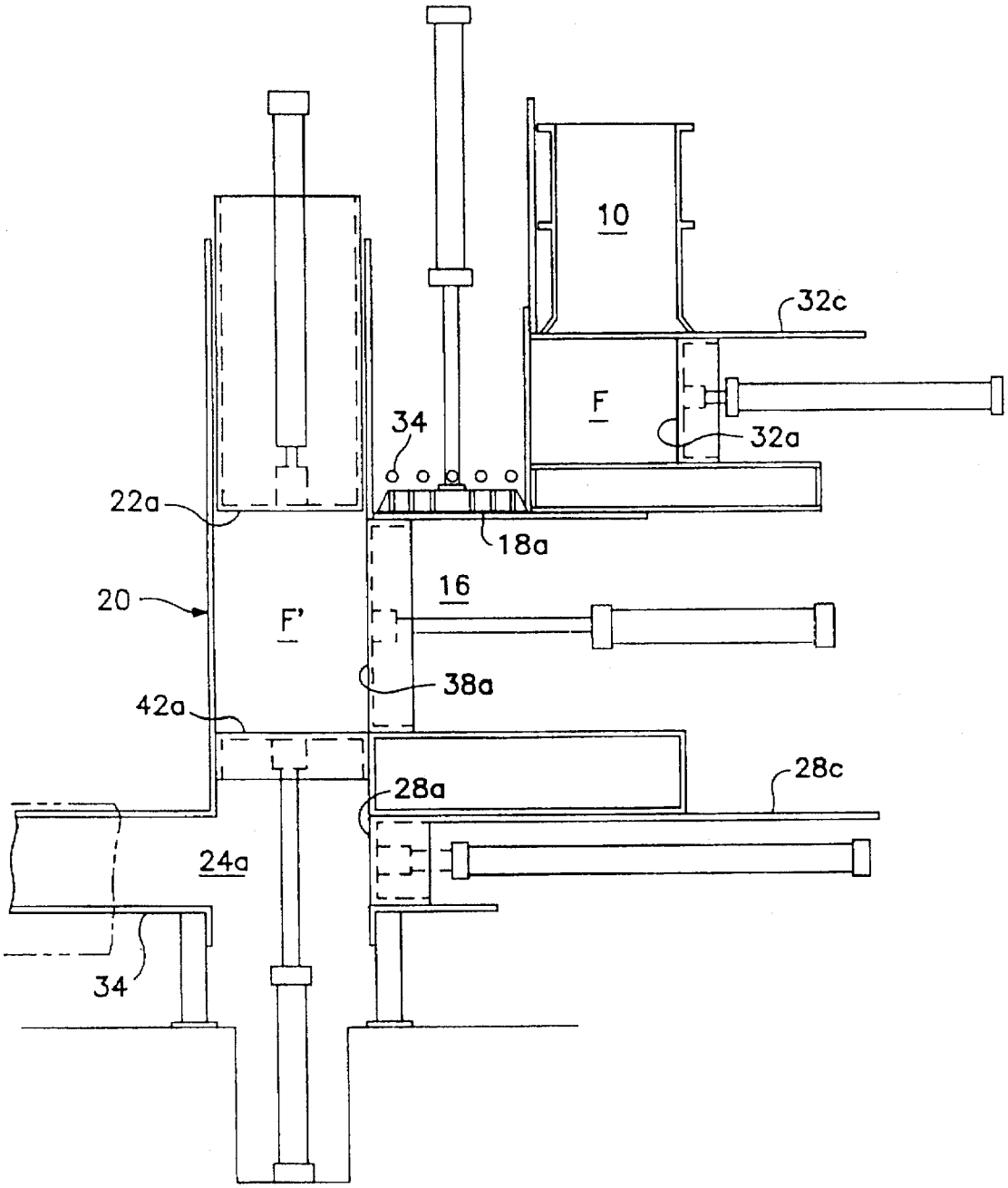

FIGS. 7, 8 and 9 illustrate the transfer and compression cycles. In FIG. 7, compacted fiber mass F' is transferred from the tramping chamber 16 into compression chamber 20. Prior to the transfer, movable secondary 42a is extended to a top position, as shown in FIG. 7. Main platen 22a remains at its home, fully retracted position. The compacted fiber mass is then transferred into the compression section 24 of compression chamber 20. Transfer plate 38a stays in its extended, transfer position to form a wall of the compression section. With the fiber compacted mass defined between the secondary platen and the main platen, the two platens begin a synchronized, downward movement. However, secondary platen 42a stops at the compression chamber opening 44 and main platen 22a continues to move downward to its intermediate position as shown in FIG. 8 where the compacted fiber mass is formed into a compressed fiber block 48 in compression section 24. Main platen 22a and secondary platen 42a move together until secondary platen 42a reaches position 54b, then main platen 22a continues forward to compress the bale between position 54a and 54b of compression section 24. After compression, both platens 22a, 42a move in unison until bottom platen 42a reaches its home, bottom position and platen 22a position 54b corresponding to the opening 44 of compression section 24 located above the ejector section 24a which corresponds generally in cross-section to the upper wall of ejection section 24a. The compressed bale 48 is held between the two platens in front of the ejection opening 26a. However, since the fibers are compressed mainly between the two platens, and the compressed fiber block is fairly stable, there is no need for a door across the ejection opening. This eliminates the need for rollers, bearings, and other mechanical assemblies required for a moving door. Compression section 24 may be smaller in height than ejection section 24a so that after secondary platen 42a reaches its home position, main platen 22a may need to be retracted to position 54b whereupon some compression release may be had.

Figure 10:
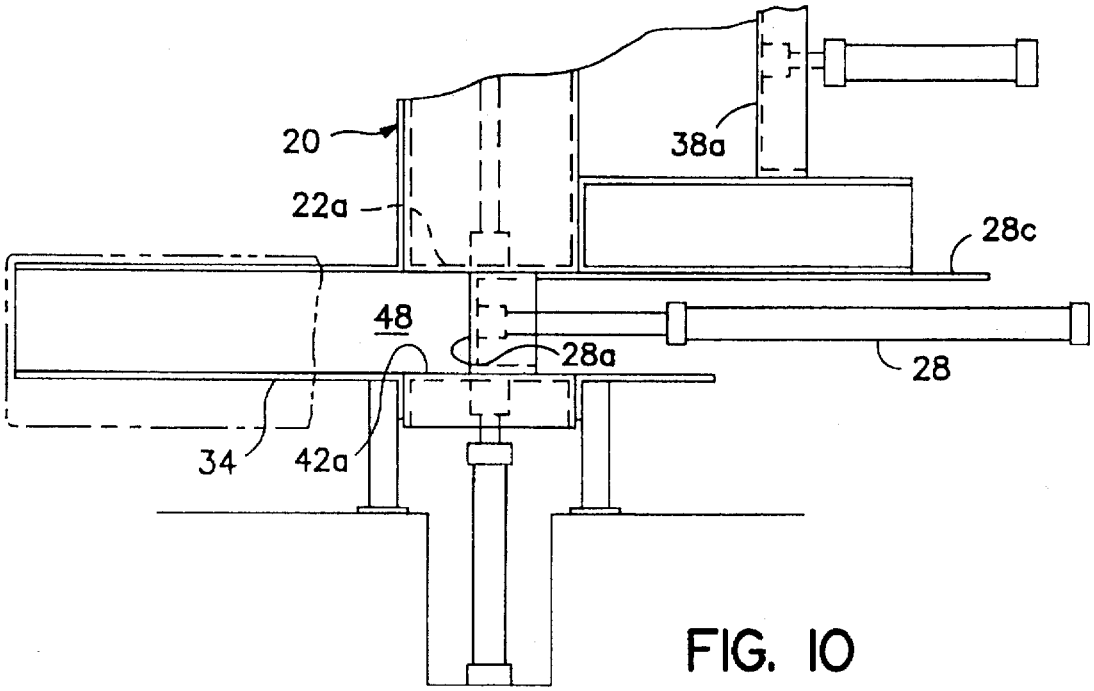
Figure 11:
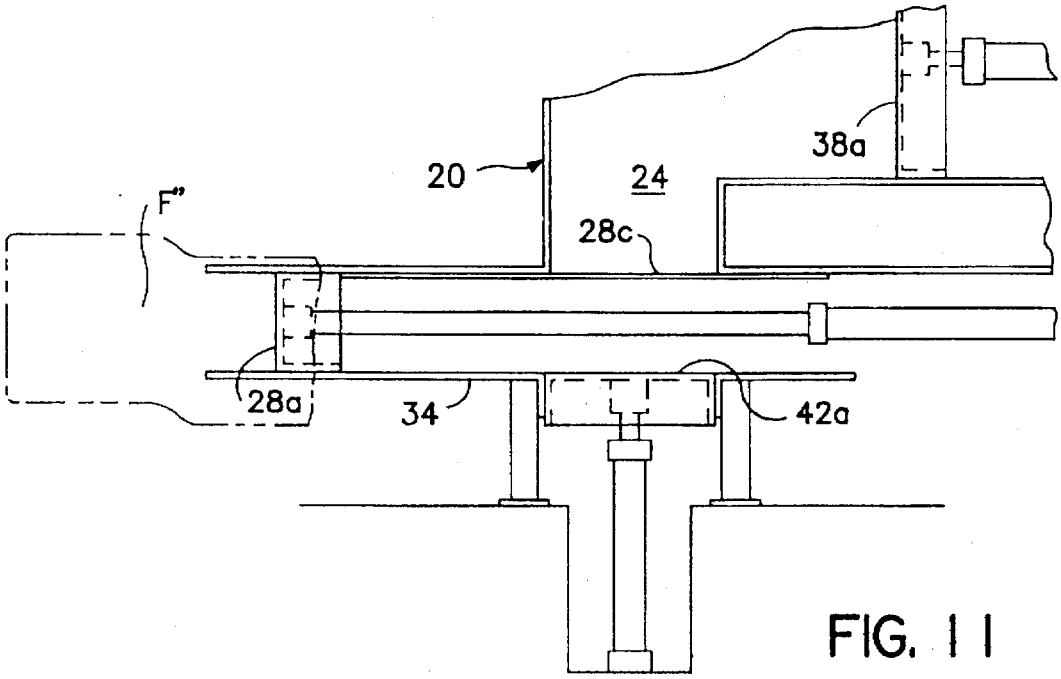

Referring now to FIGS. 10 and 11, the ejection cycle will be described. At the beginning of the ejection cycle, main platen 22a is still in its fully extended position where it occupies the chamber opening of the ejection chamber. Ejector platen 28a has begun its forward travel and shelf door 28c is almost closing the chamber opening. Ejector platen 28a begins to force the compressed fiber block through the ejection sleeve into bag 30. As soon as the chamber opening is fully closed by the shelf door 28c, main platen 22a is retracted to intermediate position at 54a so that the supply, tramping, and transfer cycles may continue so that the formation of a compacted fiber mass F' may again proceed as described above. After another compacted fiber mass is formed, ejector platen 22a will be retracted to its home position and the compacted fiber mass may be transferred, compressed, and ejected, as described above. During the ejection cycle, the compressed fiber blocks will be expanded into flexible bag 30 as described previously in relation to FIGS. 4 through 4B.

Figure 13A:
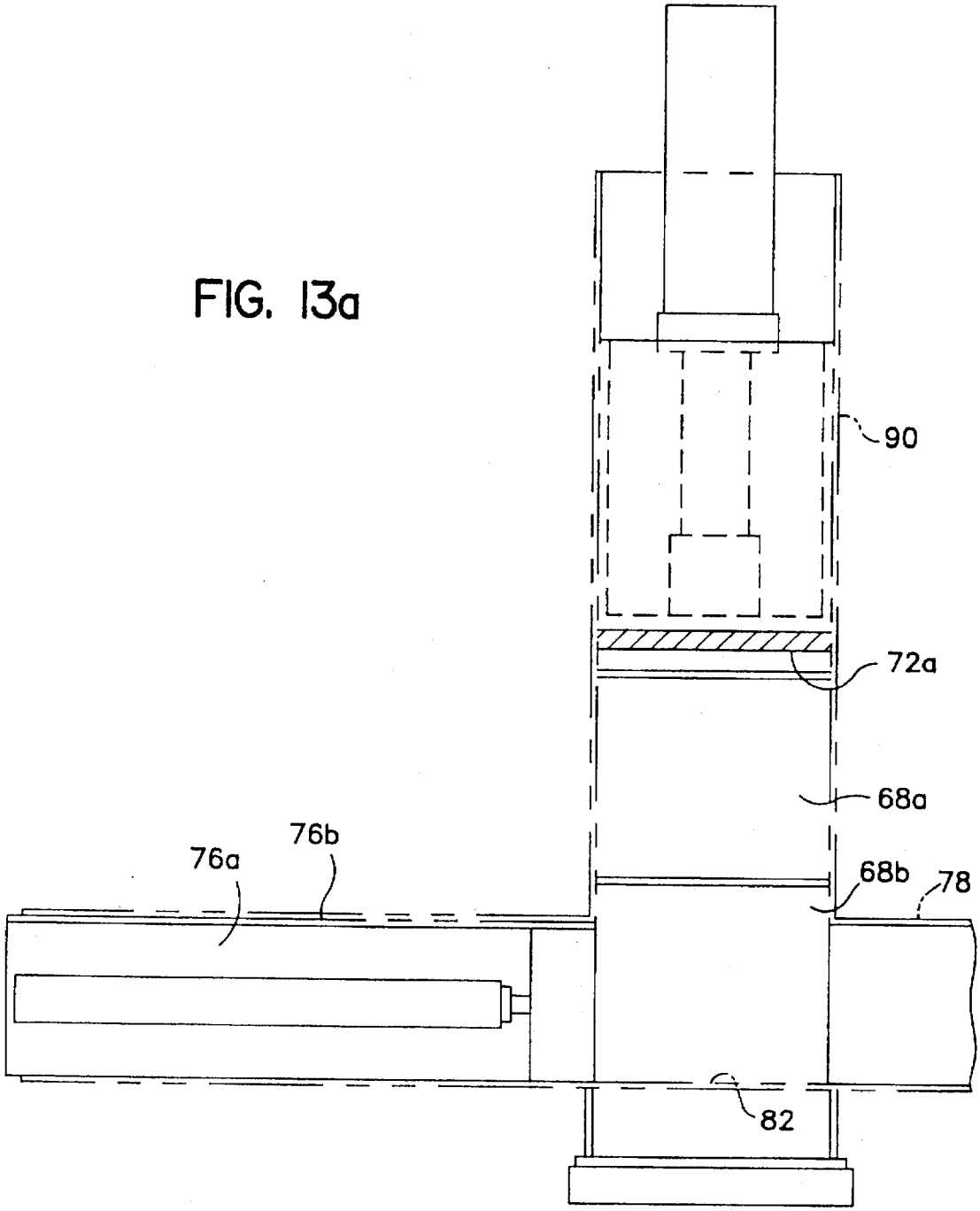

Referring now to FIGS. 12–19, another embodiment of a strapless fiber baler, designated generally as A', according to the invention will be described. Basically, baler A' is like baler A, and the major difference is that the ejection sleeve is rotated ninety degrees and requires an ejector door. Baler A' includes a supply chamber 60 which includes a condenser screen 60a for the separation of air and fiber. As can best be seen in FIGS. 13 and 13a, the baler includes a fiber supply chamber, designated generally as 62, having a pusher plate assembly, designated generally as 64. A fiber tramping section is designated generally as 66, and a transfer assembly is designated generally as 68. There is a fiber compression section, designated generally as 70, having a main platen assembly, designated generally as 72. There is bale ejection section, designated generally as 74, having an ejector platen assembly, designated generally as 76. There is an ejection sleeve 78 which is like ejection sleeve 26, except as to dimension.

Referring now in more detail to baler A' as can best be seen in FIG. 13, pusher plate assembly 64 includes a pusher plate 64a and a pusher ram cylinder 64b connected to a suitable source of hydraulic fluid for actuation. Tramping section 66 includes tramping assembly 63 which includes a tramping plate 63a and a ram cylinder 63b connected to any suitable source of hydraulic fluid for actuation. A plurality of fiber retaining elements 80 are disposed in the fiber tramping section in the form of stationary angled webs which fit between slots 82 formed in the tramping plate. An effective tramping chamber 66' is defined between retaining webs 80 and an opposing wall 82 in which compacted fiber mass F' is formed. There may be provided in some applications, a movable door 83 which is unattached and rides by gravity on the top of tramping plate 63a and stops on an abutment 83a in tramping chamber 66 to close of supply opening 62a, the door is lifted on the return stroke by the tramping plate. Optionally, a movable floor 85 may also be provided which extends into tramping chamber 66 to hold the fibers pushed out of supply chamber 62, and prevent their falling unevenly into the bottom of tramping section 66'. For this purpose, a pneumatic actuator 85a may be provided to reciprocate the moving floor in timed relation to tramping plate 63a so that the door is open just prior to the extension stroke of the tramping plate.

Transfer assembly 68 includes a pair of transfer plates. There is a first transfer plate 68a and a second transfer plate 68b. There is a ram cylinder connected to a suitable source of hydraulic fluid for actuating each plate. Tramping chamber 66' is indirect communication with compression chamber 70a forming part of the compression section 70. Main platen assembly 72 includes a main platen 72a and a main ram cylinder 72b connected to a suitable source of hydraulic fluid for actuation. Ejector platen assembly 76 includes an ejector platen 76a and an L-shaped shelf having a top surface 76b and a side surface 76c. There is an ejector ram cylinder 76d connected to a suitable source of hydraulic fluid for actuating ejector platen 76a.

Operation

In one example of the invention, ejection sleeve 78 was dimensioned as twenty-seven inches wide and twenty-seven inches high. A strapless bale of fibers in bag 30 is produced having the general dimension of twenty-eight inches by forty inches by fifty-four inches, e.g. about a fifty percent expansion of fibers in height.

Figure 14:
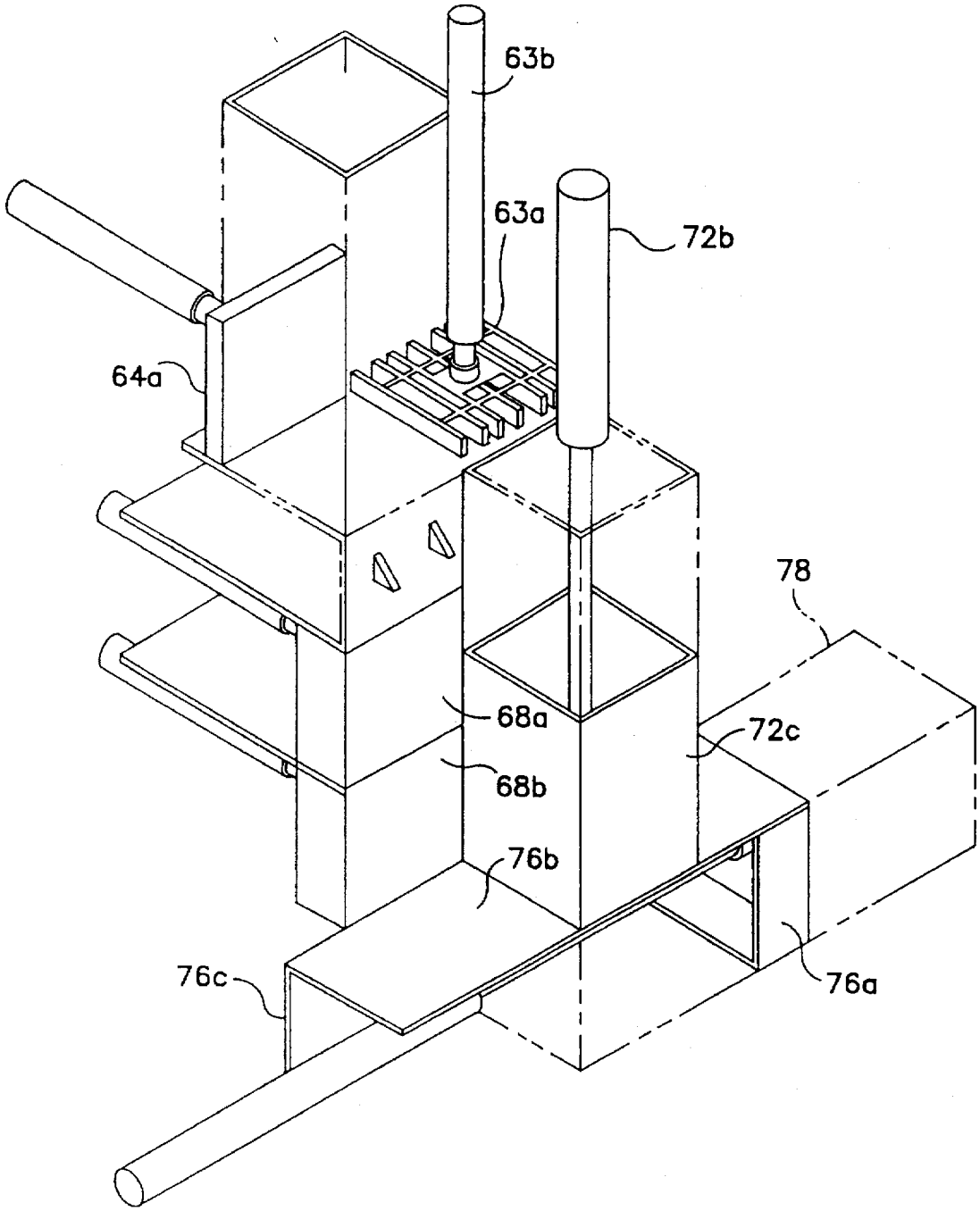
Figure 15:
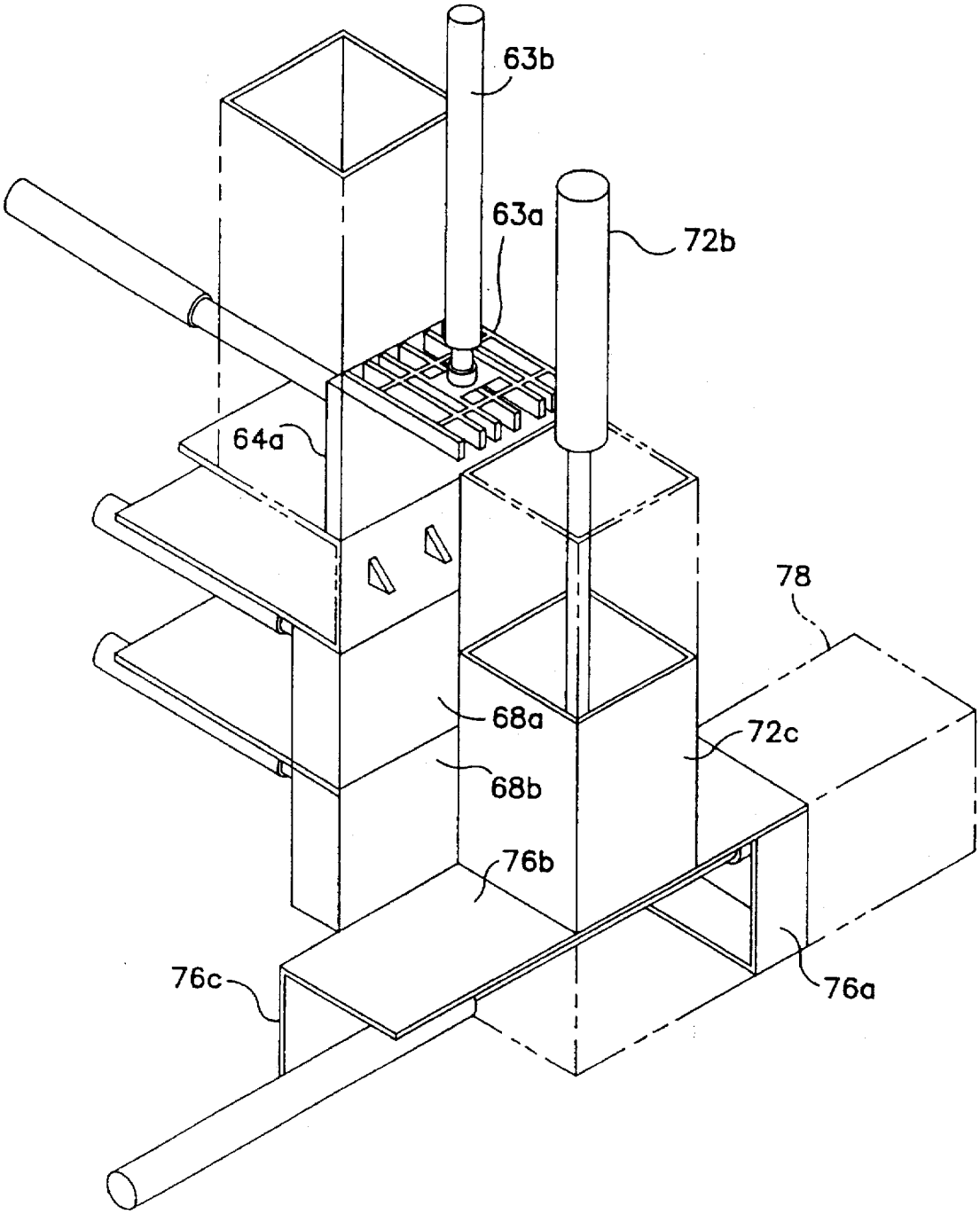
Figure 16:
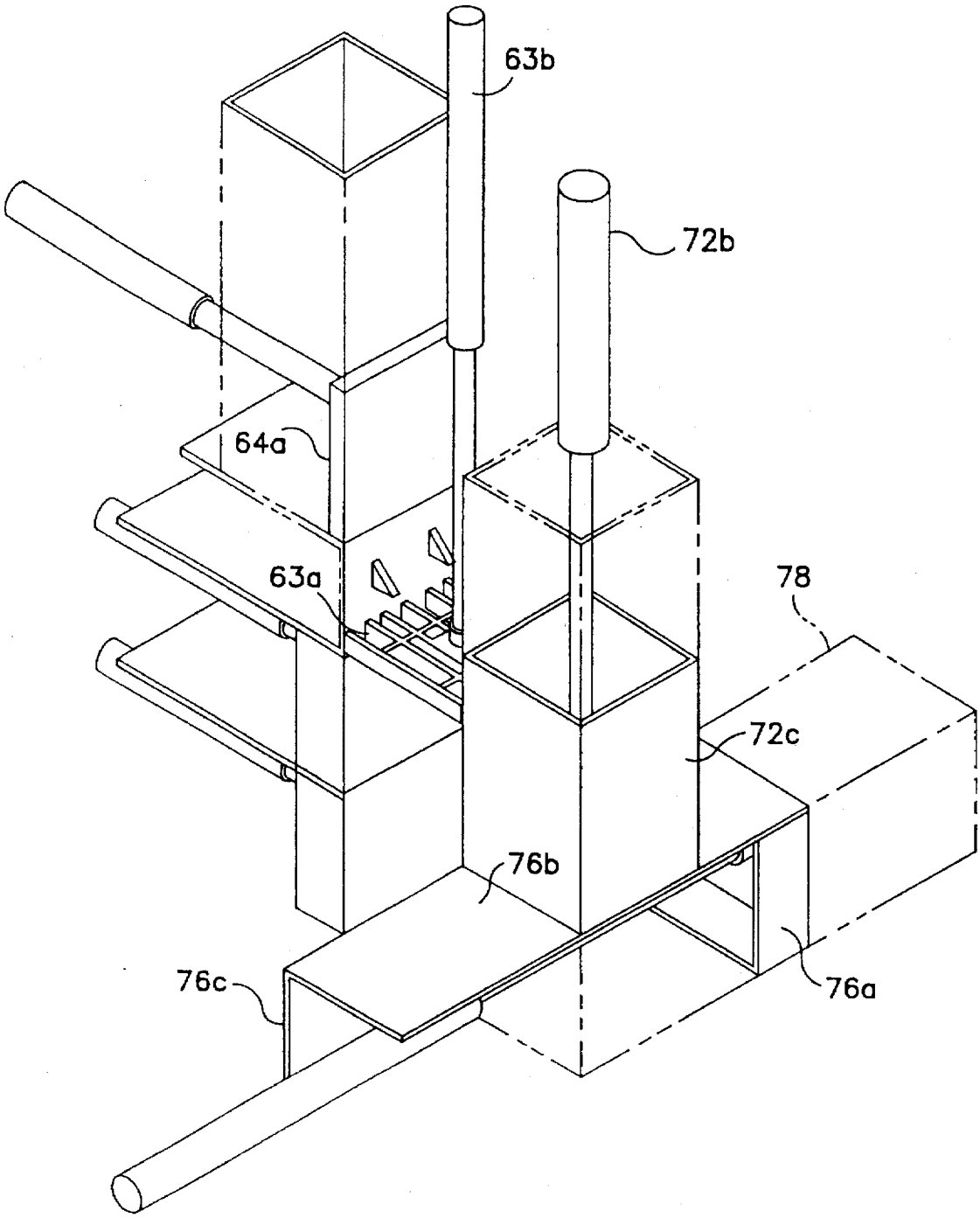

Referring now to FIG. 14 through 19, the operation and method of the present invention of embodiment A' will now be described. FIGS. 14 through 16 show the supply and tramping cycles of the invention wherein loose fibers F are pneumatically conveyed or by gravity, and pushed into tramping section 66 (FIGS. 14 and 15). Next, the transfer fibers are tramped in the tramping chamber by a forward stroke of tramping plate 63a. Pusher plate 64a remains at its extended position to form a wall of the tramping section at this time (FIG. 16). Next, tramping plate 63a is retracted, pusher plate 64a reciprocates and more loose fibers are pushed into the tramping chamber section. This process is repeated until the desired quantity or weight of loose fibers are compacted into fiber mass F' in tramping chamber 66'. It will be noted that during the tramping cycle, ejector platen 76a and the ejector shelf (wall 76c) are in an extended position to form a wall of tramping chamber 66' and main platen 72a, including a rectangular shroud 72c is also in an extended position to form a wall of the tramping chamber (FIGS. 14–16). Typically, about nine strokes of the tramping plate will occur during a tramping cycle.

Figure 17:
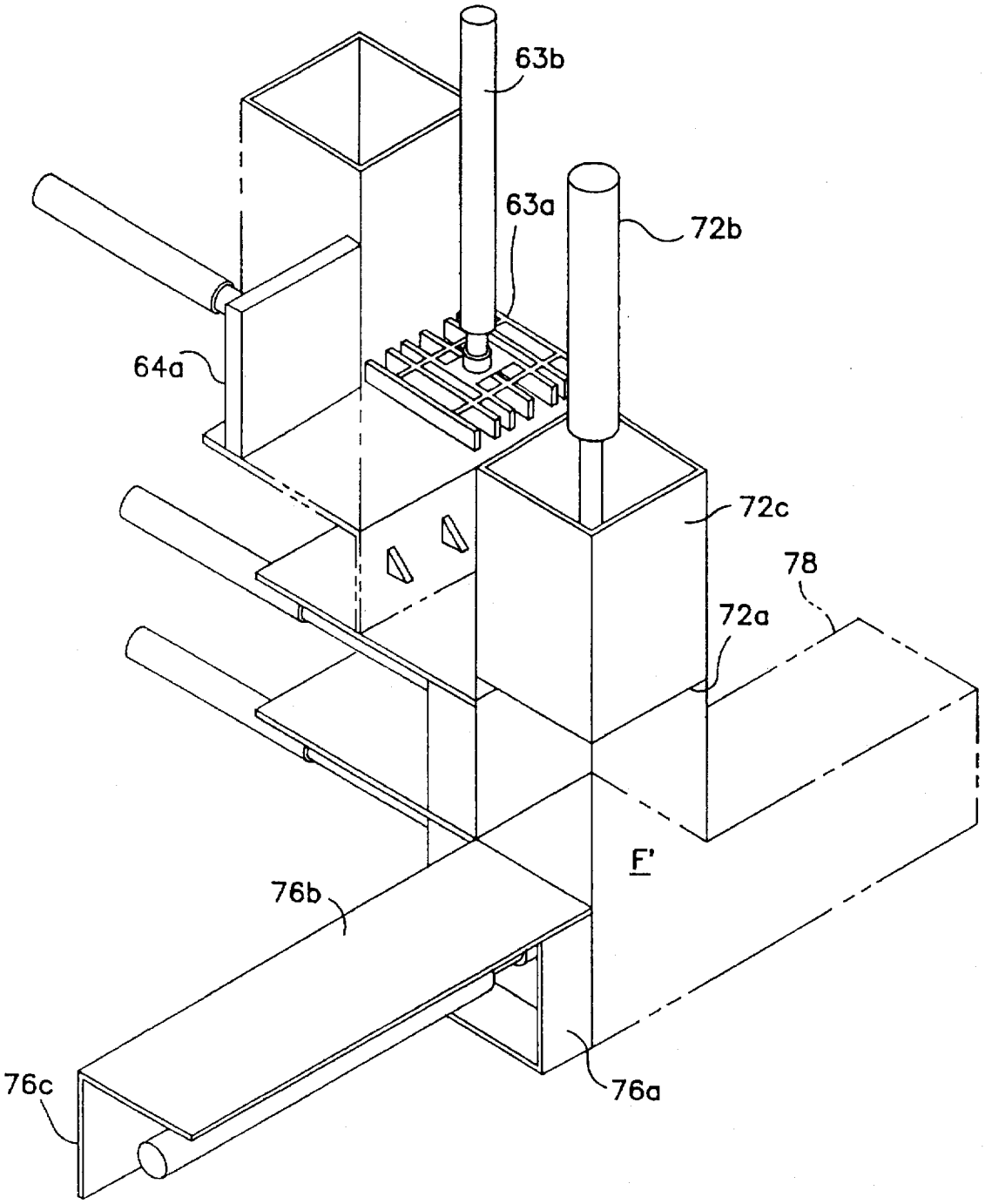
Figure 18:
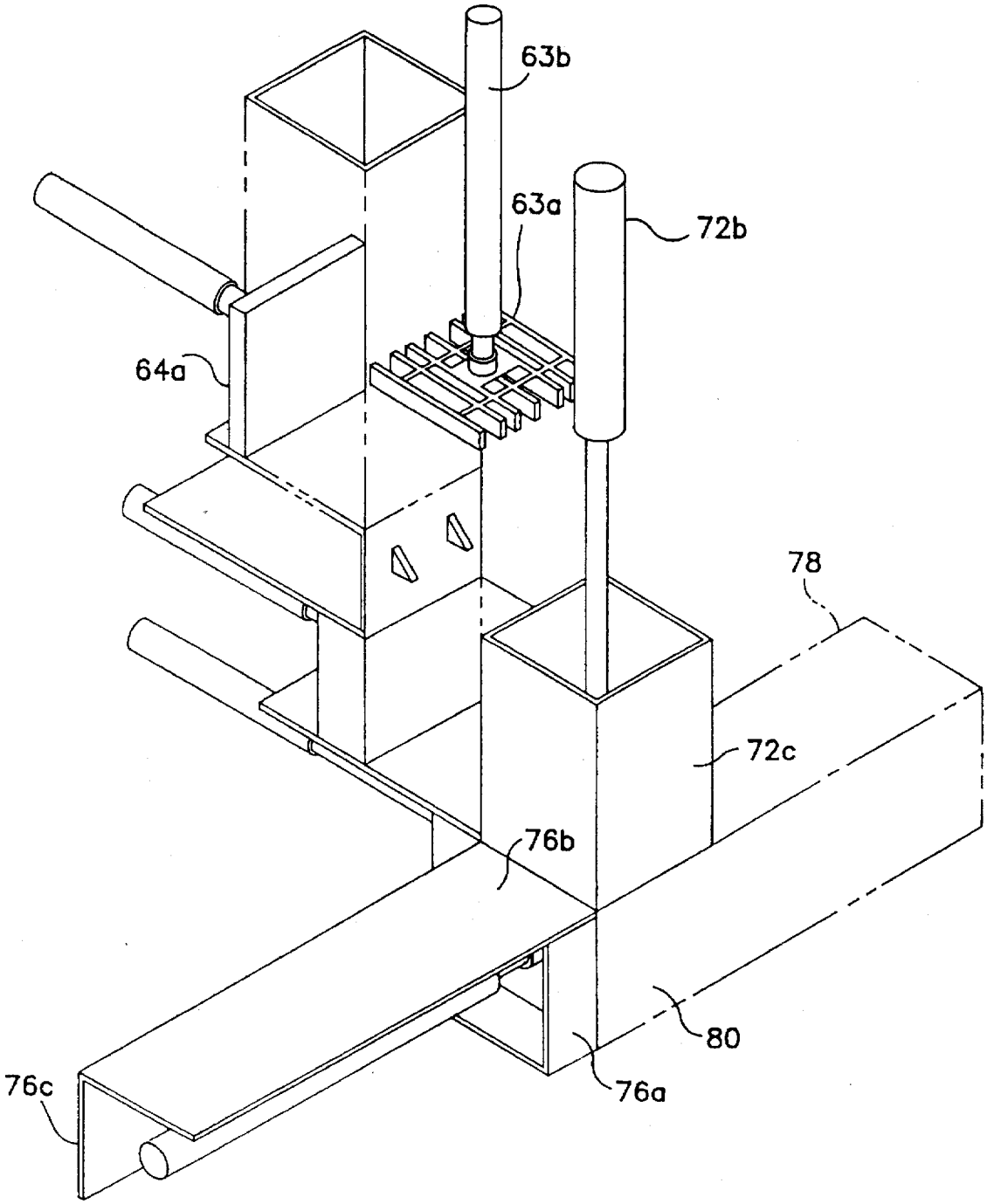

The transfer and compression cycles are illustrated in FIGS. 17 and 18, respectively. First, compacted fiber mass F' is transferred from tramping chamber 66' to compression chamber 70a. Prior to this, ejector platen 76a and main platen 72a have been returned to their retracted, home positions (FIG. 17). Both transfer plates 68a and 68b are in their extended transfer position to complete the transfer and begin the compression stroke and cycle. Main platen 72c is extended forward on its compression stroke to form a compressed fiber block 80 (FIG. 18). At that time, first transfer plate 68a is retracted so that the supply and tramping cycles may continue and the formation of a compacted fiber mass resume. It will be noted that second transfer plate 68b and main platen 72a form walls of compression chamber 70a during and at the end of compression.

Figure 19:
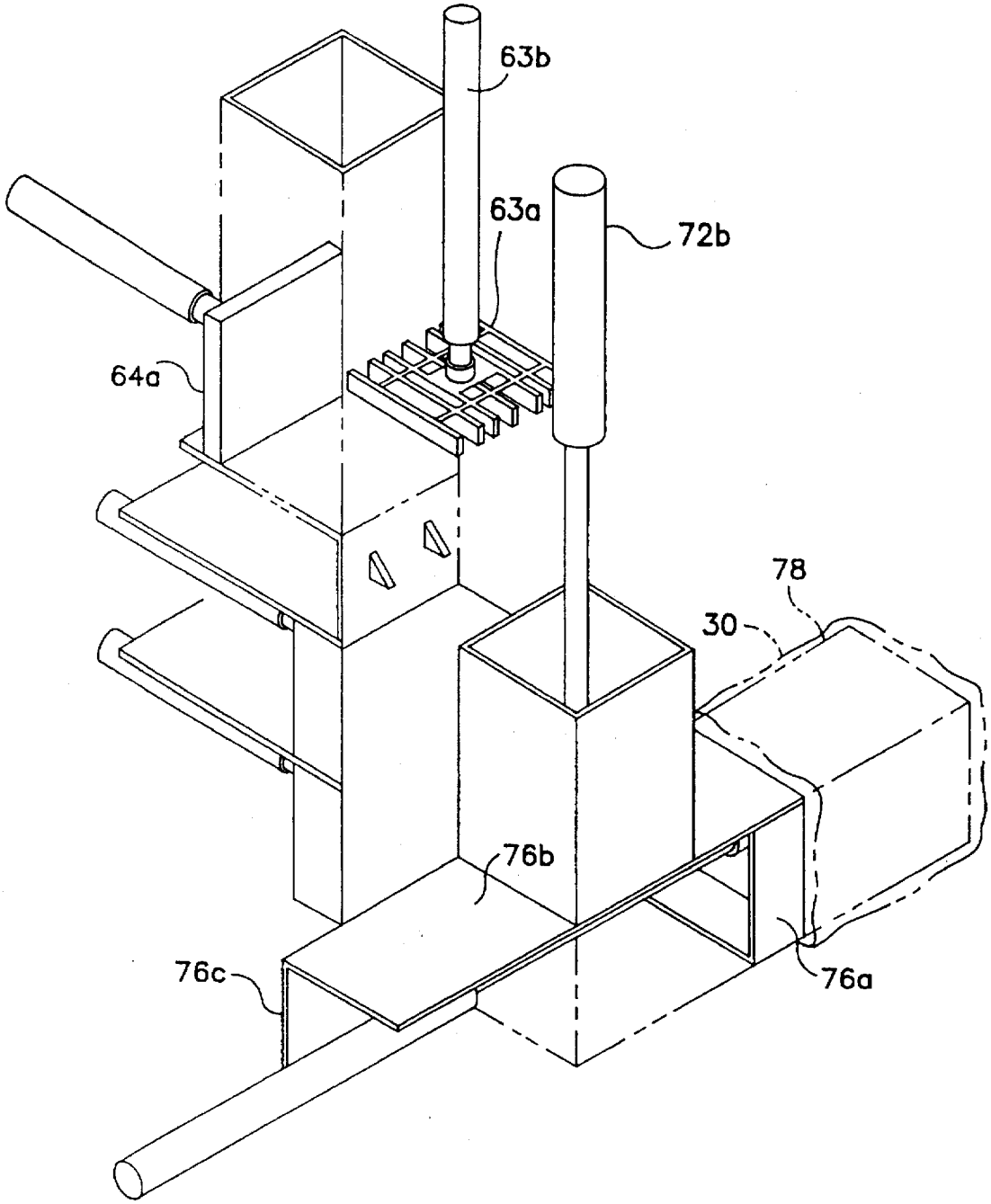

The ejection cycle is illustrated in FIG. 19, wherein compressed fiber block 80 is ejected out of the compression chamber and through the ejection sleeve into flexible bag 30. Once shelf plate 76a has moved past the face of transfer plate 68b, transfer plate 68b is retracted so that the full space of tramping chamber 66' is available for forming compacted fiber mass F'. Shelf plate 76b also blocks the opening formerly blocked by main platen 72a so that main platen 72a may be retracted to its home position, after another compacted fiber mass is formed. The ejection stroke of ejector platen 76a continues until the compressed fiber block is completely inserted in flexible bag 30.

FIGS. 20–40 illustrate another embodiment of the method and apparatus of the invention for producing a strapless fiber bale wherein the tramping chamber and compression chamber are in axial alignment in a strapless baler, designated generally as A". Loose fibers are fed from a supply into a tramping section, designated generally as 90 (FIG. 20), of the baling machine and formed into a compacted fiber mass, denoted by broken lines 92, within a fiber tramping chamber, denoted by line 94. Tramping chamber 94 is of a rectangular cross-section and formed by suitable closures, as will be explained more fully later in the description. The compacted fiber mass 92 is formed by successively depositing loose fibers into the chamber and pushing them forwardly by means of a main platen assembly, designated generally as 96, which includes a platen 98 reciprocated by a plurality of tramping cylinders 100, 102 during a tramping cycle. A main compression ram cylinder 104 is disengaged from the platen during the tramping cycle. Each time loose fibers are pushed into the fiber block, as at 98', a plurality of releasable fiber retaining elements 106 are released and permit the passage of the platen. When the platen returns on the retraction stroke, the retaining elements are engaged to hold the fiber mass in place. A prescribed amount of loose fibers are compacted into the mass during the tramping cycle.

Once the tramping cycle is completed, main ram cylinder 104 engages with the tramping cylinders 100, 102 and the platen 96 pushes the fiber mass forward during a compression cycle into a compression chamber, designated generally as 108, to form a compressed fiber block denoted by dotted lines 110. It is noted that the fiber mass is compressed in the same direction as it was previously tramped to define a compression face 112 of block 110. After compression, platen 98 remains at the compression position shown at 98" to form a wall of the compression chamber and the compressed fiber block 110 is ejected by an ejector platen 114 through an ejection sleeve 116. For this purpose, a moveable ejector door 118 is provided on rollers having an ejection opening 120 which is aligned with the compression chamber during the ejection cycle so that a first edge of the opening 120a is outwardly off-set with respect to the face 114a, or edge 174, of platen 98 to slightly relieve compression and facilitate ejection of the bale (FIG. 33). A second side edge of the opening 120b is flush with compression wall 122 of the compression/ejection chamber. It will also be noted that ejector platen 114 forms a wall of the compression chamber prior to the forward stroke during the ejection cycle (FIG. 20). With ejection door 120 in alignment with the compression chamber, the ejection cycle will begin to force compressed block 110 (48) through the ejection sleeve 116. For this purpose, a wall 124 of the ejection sleeve is also off-set relative to edge 120a and platen 114 to relieve compression as will be described later. Flexible bag 130 is fitted over the ejection sleeve (FIGS. 4, 20). The dimensions of the ejection sleeve and flexible bag are important to the method and apparatus of the present invention due to the fact that the compressed bag of fibers possesses high rebounding forces due to the compressibility and resiliency of the fibers. The relative dimensions of the ejection sleeve and flexible bag 130 are described above in reference to FIG. 4. This allows an expansion space which allows the compression face of the bale and the compressed face to rebound upon exiting the ejection sleeve and entrance into bag 130. Otherwise, if the bag and ejection sleeve were dimensioned the same, or to closely the same, the rebounding forces of the compressed fiber block would burst the bag. The dimensions of the ejection sleeve and bale produced are the same for the bales of the FIG. 12 embodiment, e.g. bale dimensions of about twenty-seven inches by forty inches by fifty-four inches.

It will be noted that ejector platen 114 carries an ejector shelf door 131 which covers a compression chamber opening 132 occupied by platen 98 during the ejection cycle (position 98") so that platen 98 may be retracted to once again be utilized to continue to a tramping cycle since loose fibers will be tramped against the shelf door and not fall behind the ejector platen.

The embodiment of FIG. 20 may be provided in either a vertical arrangement or a horizontal arrangement. In a vertical arrangement, the schematic illustration of FIG. 20 may be viewed as a side elevation, and in a horizontal configuration, the illustration of FIG. 20 may be viewed as a top plan view. FIG. 20 actually represents a top plan view of a horizontal embodiment which is illustrated in FIG. 21. In the vertical arrangement, a side supply opening 133 may be provided for depositing the fibers, such as illustrated in the embodiment of FIG. 2 where a condenser 10 and supply chamber 12 are provided. In this case, supply opening 133 may correspond to the opening of chamber 12a into tramping chamber 16. In the vertical arrangement, a shelf door 98a affixed to and carried in reciprocation with platen 98 covers opening supply 133, which is on the near side of FIG. 20, through which fibers are supplied whenever platen 98 is moved past the opening on the tramping and compression side of the machine. In the horizontal arrangement, shelf 98a covers the compaction chamber opening 150a whenever the platen head is on the tramping and compression side of the opening, as can best be seen in FIGS. 28, 31.

Referring now to FIG. 21, a perspective view is illustrated of a strapless baling machine in the form of a strapless horizontal fiber baler, designated generally an "A". There is a filling chamber, designated generally as 140, which includes a compactor ram assembly, designated generally as 142, which reciprocates a compactor plate 142a. There is a side chamber opening 144 in which loose fibers may be delivered, such as from a cart lifter/dumper assembly, illustrated generally at 146, in FIG. 22. There are a plurality of guide rods 148 which guide the reciprocation of compactor plate 142a to pack the fibers into a compaction chamber, illustrated generally at 150, which is disposed below the filling chamber. Fibers dumped into the filling chamber fall into the compaction chamber and are packed by plate 142a. As many carts 146a as are necessary are utilized to provide a desired weight of fibers for the fiber bale being formed are lifted and dumped into filling chamber 140. Each deposit of fibers is packed to the size shown in FIG. 24. Compaction plate 142*a* stays in the position shown in FIG. 24 to form a top wall of the compaction chamber during the tramping cycle.

As mentioned previously, the tramping cycle is carried out by tramping cylinders 100, 102 connected to a suitable source of hydraulic fluid for actuation. As can best be seen in FIGS. 21, 23, and 27–30, a unitary frame designated generally as 154 supports the various chambers in which the fibers are processed, as well as the various ram assemblies which move plates and platens within those chambers. For example, tramping and main platen ram cylinders 100, 102, 104 are carried by an overhead frame portion 154*a* which is supported above the ground by channel frames 154*b* and a base frame 154*c*. For this purpose, U-bolts 156 are provided, as can best be seen in FIGS. 27, 28. Shelf door 98*a* slides on channels 154*b* by means of slide blocks 98*b* and spacer legs 98*c*. Not only does this construction facilitate sliding of the shelf door, but it also serves to maintain main platen 98 in alignment with the tramping and compression chambers, particularly during the compression cycle when all three cylinders are acting on the platen. Friction resistant wear blocks 98*b* are also carried on the sides and, if needed, bottom of the platen head 98 to prevent wear of the side and bottom plates of the chamber enclosure, which is also carried by unitary frame 154, as can best be seen by FIGS. 21, 23, wherein various outer enclosure plates 156 are generally illustrated. For example, enclosure plates 156 may include four sides (156*a*, 156*b*, 156*c*, 156*d*) which form an enclosure for the chambers previously referred to herein, i.e. tramping and compression, except for the walls provided by the moveable platens and plates. Any suitable construction techniques such as welding may be utilized to make the unitary frame.

At the forward end of the main ram assembly, cylinder support blocks 160*a*, 160*b* are provided for supporting the main ram and tramping cylinders, as can best be seen in FIGS. 29, 30. Blocks 160 are affixed to a plate 162 secured to side frame members 156*a*, 156*b* (FIG. 30), plate 162 has been omitted from FIGS. 28, 29 for clarity. Other reinforcing structure may be added to the main ram assembly as needed. Piston rod 100*a* of tramping cylinder 100 is affixed to platen 98 by any suitable means of affixation in collar 100*b*, such as bolt 100*c* (FIG. 33). Piston rod 102*a* of tramping cylinder 102 is likewise affixed to platen 98 by means of a fixed collar arrangement 102*b*. Thus, the tramping ram cylinders are always engaged and affixed. However, as can best be seen in FIG. 30, piston rod 104*a* of main ram 104 is not affixed to head 98 but has a tapered end 104*d* which is received in a collar 104*e* likewise having a taper so that the piston rod may easily fit in the collar to exert and drive platen 98 during the compression cycle.

Referring now in more detail to FIGS. 31 through 34, the ejector section of the strapless baling machine will now be described. As can best be seen in FIG. 31, with main platen 98 on the full compression stroke during the compression cycle with main ram cylinder 104 engaged, compression chamber 108 is defined by platen 98, ejector platen 114, compression wall 122, and closed ejector door 118. Of course, the top wall and bottom wall of the compression chamber are formed from metal plate side walls of the unitary frame. In this position, the compacted fiber mass has been compressed into a fiber block 110 in the compression chamber and shelf door 98*a* of the main platen assembly covers and closes the compaction chamber opening 150*a* of the compaction chamber. In this manner, filling and charging of the filling chamber 140 may continue so that on the return stroke of main platen 98, the tramping cycle may immediately continue. It will be noted that retaining elements 106 may comprise a pair of opposed racks of movable dogs, as can best be seen in FIGS. 3 and 25, and as previously described in reference to FIG. 3. Suitable proximity switches 106*a* (FIGS. 26) may be used to actuate returning elements 106 to open the elements to permit passage of platen 98 while retaining fiber mass F'.

Ejector assembly 114 is supported by unitary frame 154 including a slide block 164 carried by frame legs 158*e*. A rear portion of ram cylinder 114*b* is carried by a rear frame 166 attached to horizontal frame members 158*f* also tied into the unitary frame, as can best be seen in FIGS. 21, 32. Platen 114*a* rides on slide block 114*c* against bottom compression wall 122 to avoid wear. Platen 114*a* is toleranced with the compression chamber wall so that the problem of fiber slippage past the platen is minimized to the point of avoidance.

As can best be seen in FIG. 34, ejector door 118 is illustrated with rollers llSa which ride on a track 170 carried at the top and bottom of front frame 158*g* of unitary frame 158. For this reason, a plurality of rollers 118*a* at different angles to the track are provided, so that the door may roll freely under the large compressive forces from the bale which has been previously compressed therein. A hydraulic door actuator 172, connected to a suitable source of hydraulic fluid, is actuated for opening and closing the door using suitable controls, i.e. either automatic or manual. As illustrated in FIG. 34, the ejection door opening 120 is brought into registry with the compression chamber for beginning of the ejection cycle. FIG. 33 illustrates an offset relationship between the outer edge 174 of platen 114*a*, face of main platen 98, unitary frame plate 156*a*, and inside edge 120*a* of ejector door 118, and ejection sleeve 126. There is a first off-set 176*a* between platen 98 and wall 156*a*. There is a second off-set 176*b* between side wall 156*a* and inside edge 120*a* of ejector opening and side wall 156*a*. Finally, there is a third off-set 176*c* between inside edge opening 120*a* and ejection sleeve 126. Each off-set is progressively outward to provide a relief for the expanding block of fibers. The opposing compression wall is generally flush with the opposing side edge of platen 114*a*. However, since the compression face of the bale is on the side of main platen 98, it is this side of the compressed block of fibers that exerts an initial rebounding force that the off-sets overcome in order to eject the bale reliably and efficiently. It will be noted that side gaps 178*a*, 178*b*, 178*c* are provided. Preferably, the off-sets are generally twice the size of the gaps in the preferred embodiment.

Operation

Figure 35:
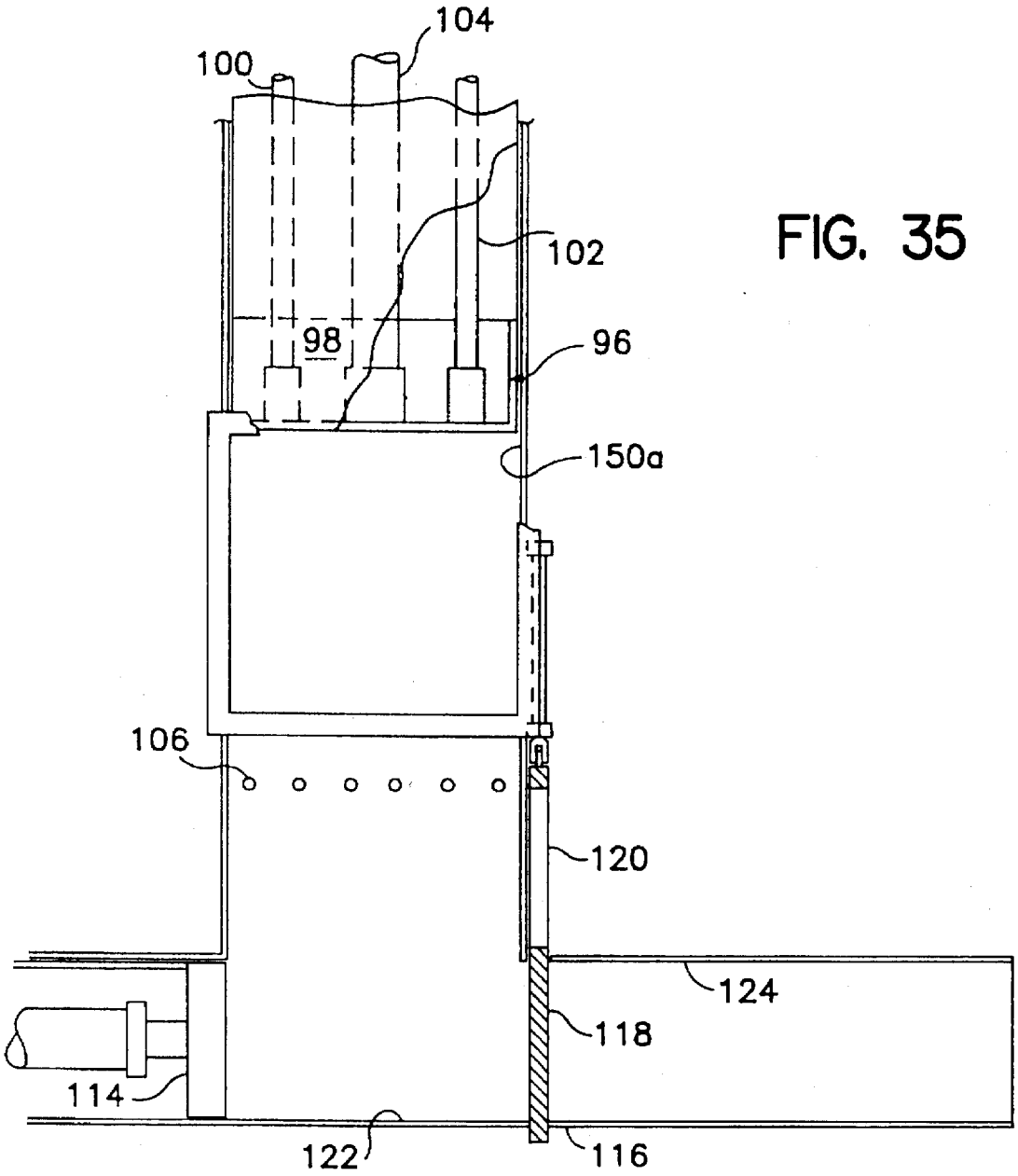
Figure 36:
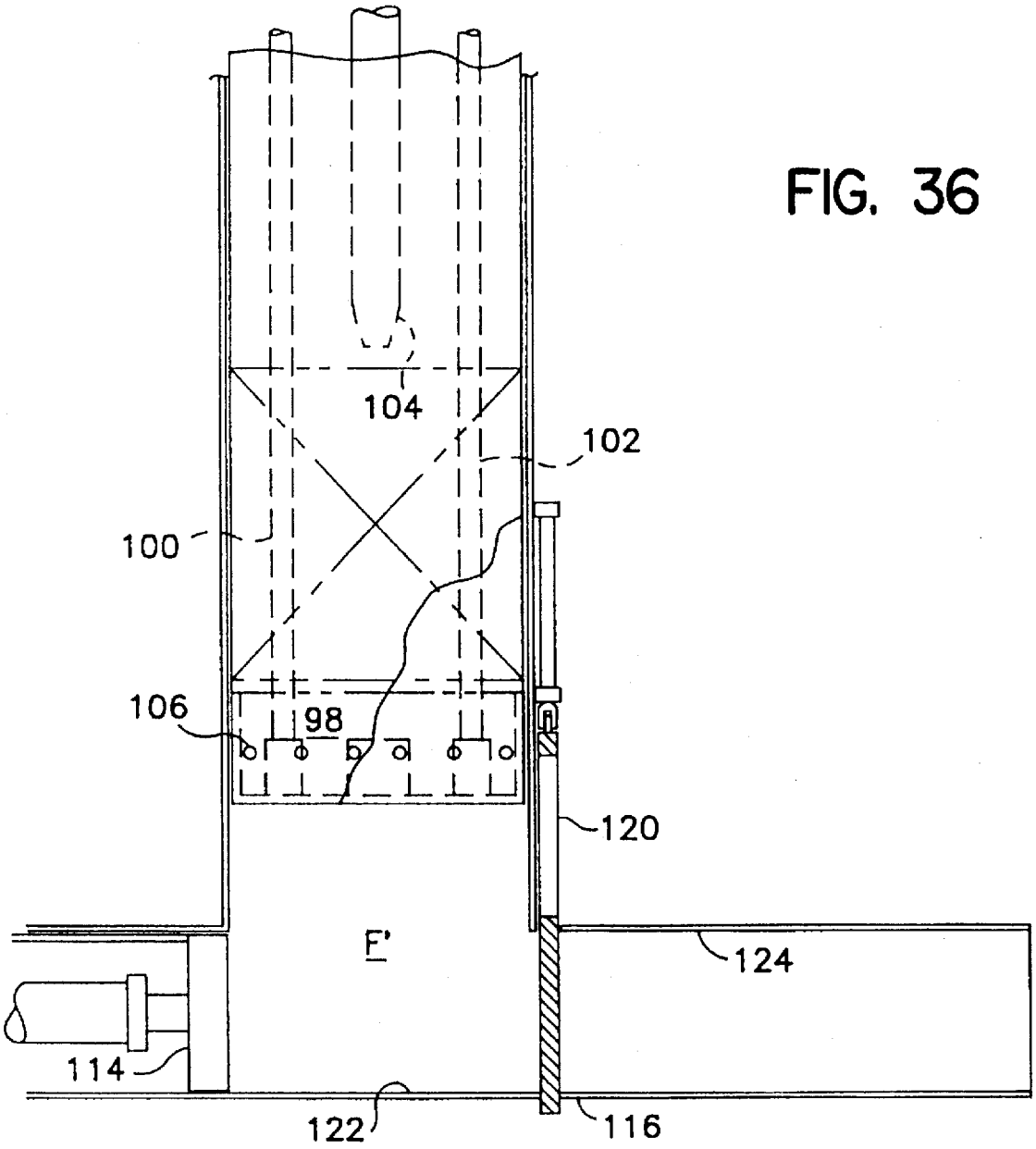
Figure 37:
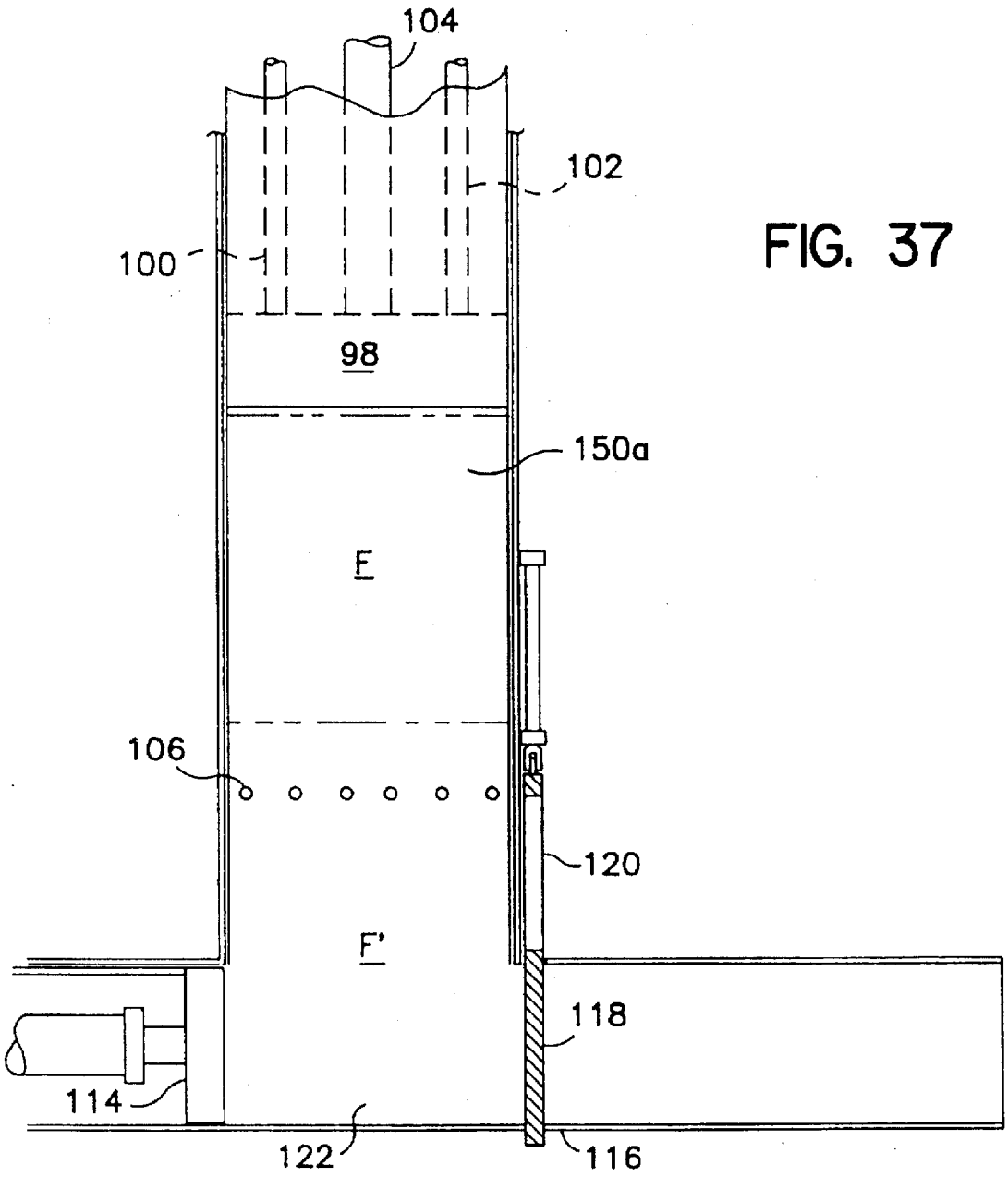
Figure 38:
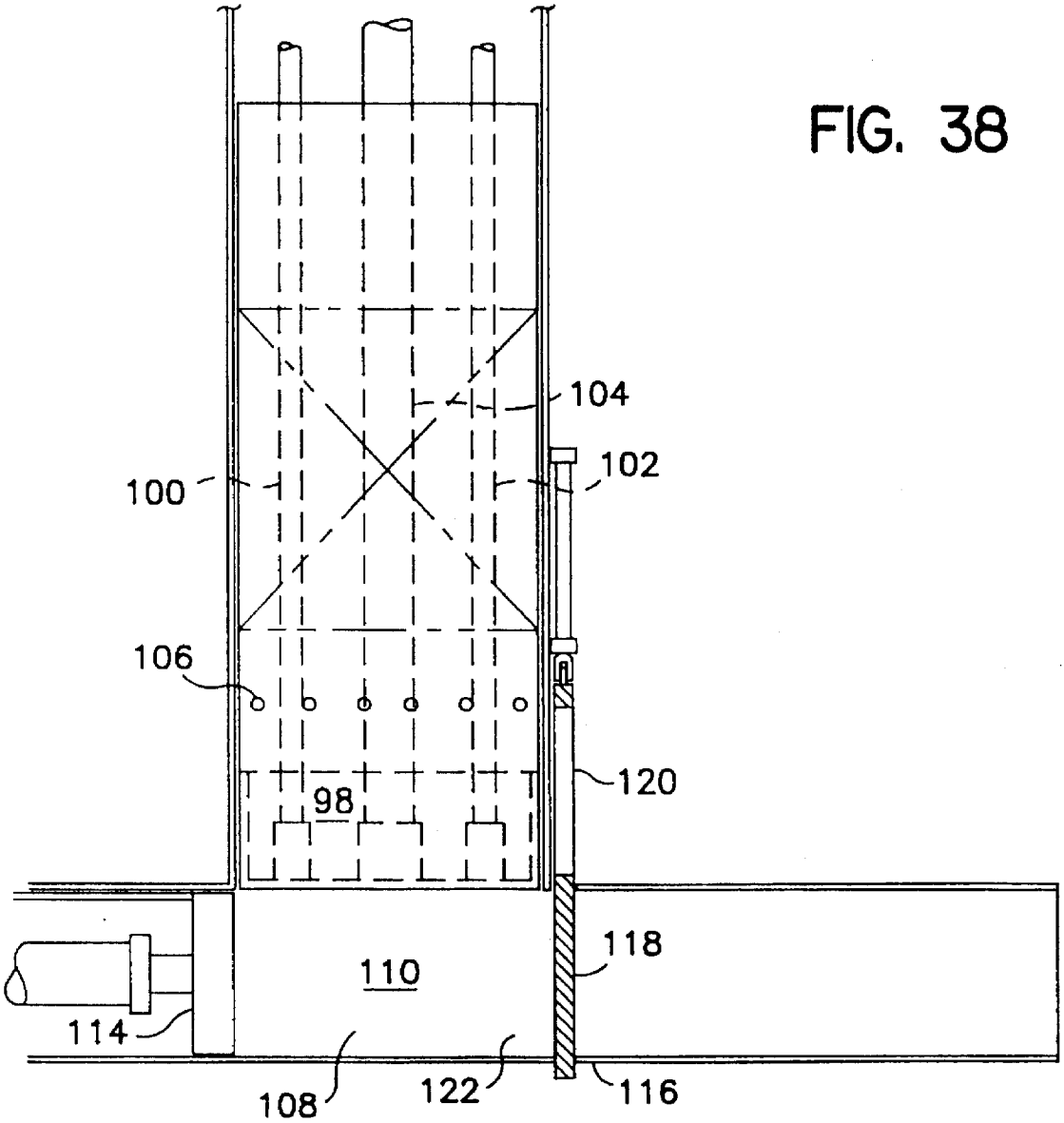
Figure 39:
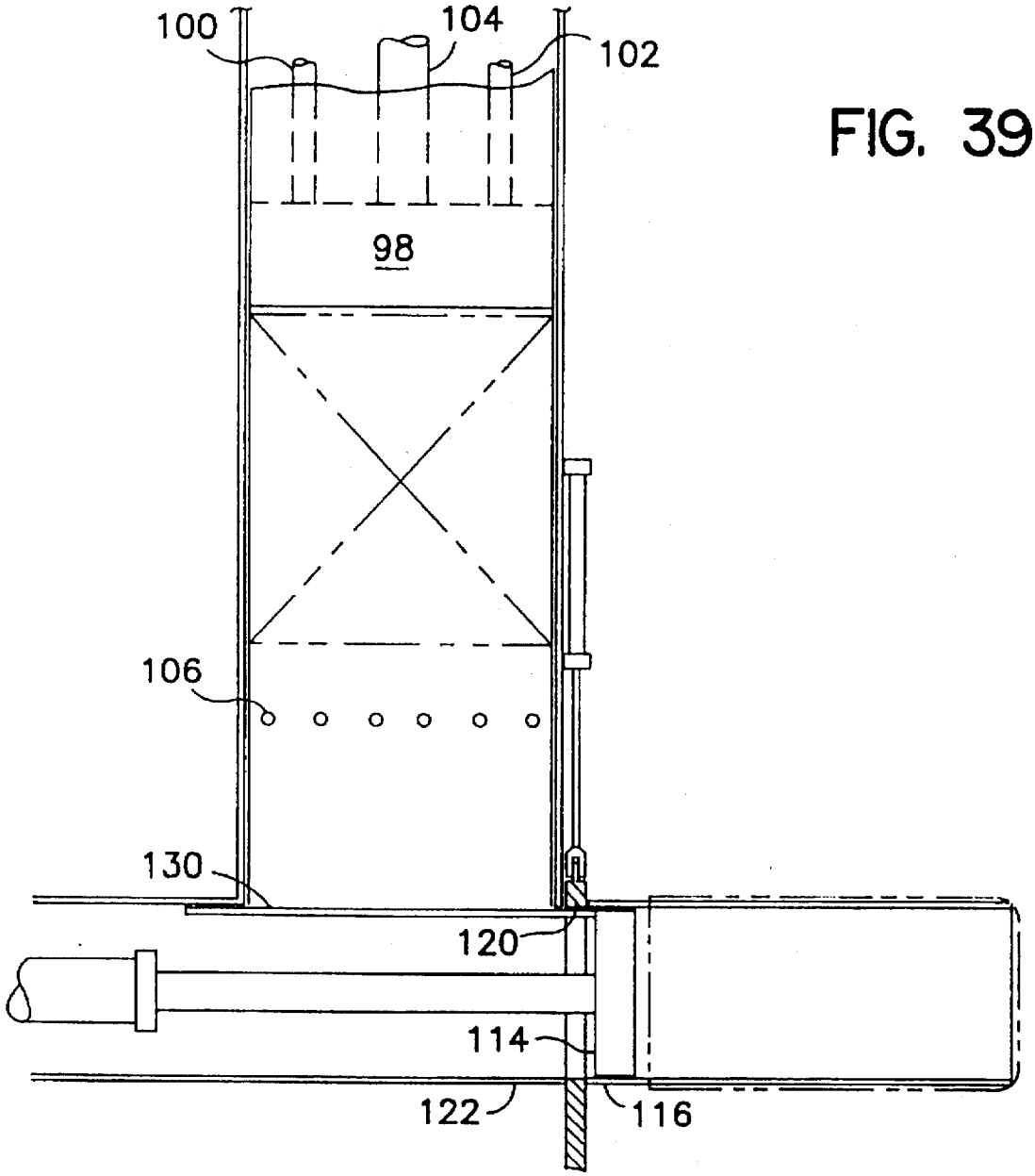
Figure 40:
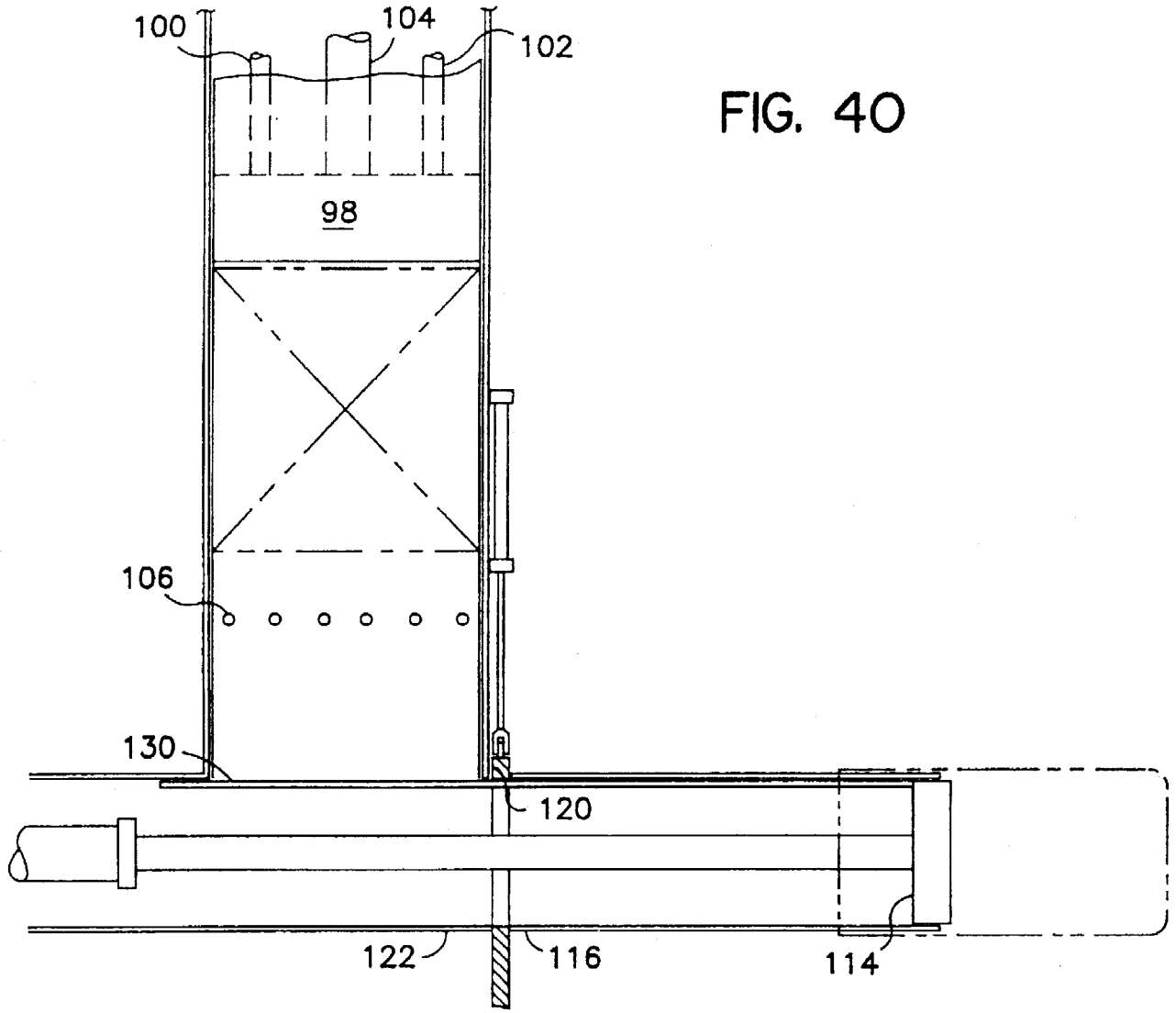

Referring now to FIGS. 35 through 40, the method and operation will now be described. First, fibers are fed through compaction chamber opening 150*a* and are packed in the compaction chamber by compaction plate 142*a* (FIGS. 24 and 35). The fibers are compacted into a fiber mass F' by compacting the fibers on the compaction side of retaining elements 106 using tramping cylinders 100, 102 (FIG. 36). Successive deposits of loose fibers F are compacted into the fiber mass until a desired amount or weight of fibers is contained in compacted fiber mass F' (FIG. 37). Next, main ram cylinder 104 is engaged with tramping cylinders 100, 102 and the desired amount of compacted fibers F' is compressed into a compressed fiber block 110 in compression chamber 108 (FIG. 38). At this time, ejector door 118 is closed. Next, ejector door 118 is opened so that opening 120 is brought into registry with the compression chamber. Once shelf 131 of ejector platen 114 has covered the compression chamber opening 132, main platen 98 may be retracted to again resume a tramping cycle (FIG. 39). Finally, compressed fiber bale 110 is ejected into bag 144 (FIG. 40).

Thus, it can be seen that an advantageous apparatus and method can be had in accordance with the present invention wherein highly resilient textile fibers may be tramped into a fiber mass having a prescribed weight, compressed into a compressed fiber block in the same direction of compaction, and then ejected transverse to the compression chamber into an oversized textile bag which accommodates the rebound expansion of the highly resilient and compressible fibers. The apparatus and method provide for efficient and optimum operation whereby movable plates and platens involved in processing the fibers form walls of the various chambers, and the various movable plates and platens may be moved back to their previous operational positions upon initiation of a subsequent cycle by using traveling shelves which move with the plates and platens to close the openings. By closing the various chamber openings, the movable plates and platens previously forming these closures may resume their normal operation e.g., to resume tramping cycles during the ejection cycles.

In some applications, it may be needed to provide air vent holes in the ejection sleeve so that in the event a bale is left in the sleeve, an air space will not be left between the next, ejected bale. For this purpose, air vents about forty-eight inches to fifty inches from the sleeve end may be provided.

Having been taught the principles of operation of strapless baling apparatus and methods according to the invention, the control of the apparatus will be apparent to one skilled in the art of hydraulic control systems. Various arrangements of hydraulic control valves operated manually, or electrically as generated by an electronic controller in response to various proximity switches and other sensors strategically placed, will become apparent. For example, in reference to the embodiment of FIGS. 20 and 21, a system will be generally described. There are a plurality of proximity switches 190–206 position as illustrated in FIG. 26 at various locations relative to the operational elements of strapless baler A". There is a controller C which receives the signals from the proximity switches and controls the actuation of compaction ram assembly 142, main and tramping ram assembly 145, and ejector ram assembly 114. Controller C then controls hydraulic actuators, illustrated schematically at 11, in the various embodiments (see FIGS. 2, 12, and 21). Controller C, while shown individually at the actuators for sake of clarity, will be understood to include a single unit with control signals sent to the actuators. The actuators may be solenoids, or other suitable switches which are activated to control fluid handling valves which control the flow of hydraulic fluid, or other control media in a conventional manner. Various linear transducers may be utilized to provide signals representing linear distances. For example, the transducers may be utilized to provide signals representing the density of compaction of the fiber mass and block due to the extent of platen travel, clearance distances between moving parts, and platen positions to assure safe operation of the fiber retaining dogs.

The example referred to will now be described in more detail. As the baling machine is operating, cart dumper assembly 146 lifts a full cart **146*a* that makes switch 183 to signal that the cart is all the way to the top. There are three down switches 184, 186, and 188. After the three down switches are made, controller C signals actuator 11 to retract compactor plate 142*a* and switch 190 is made upon the retraction stroke. After the cart dumps, the pre-tramper or compactor 142*b* is actuated and strokes down where switches 184, 186, and 188 are made by proximity of elements 142*a*, and 148** which are arranged as corners of a triangle to ensure that all three rods are down and level.

When a load of fibers is deposited into compaction chamber 150, as signaled by top retraction switch 190, the trampers and main rams are at their retraction position and switch 180 is made. When the top set of dogs 106 is open, switch 192 is made on either side. When the top set of dogs is closed, switch 194 is made on either side. When the bottom set of dogs is open, switch 196 is made on either side, and when the dogs are closed, switch 198 is made on either side. Redundancy of switches is provided for reliability. Switch 200 is made when the ejector door is in the open position. Switch 202 is made when the ejector door is in the closed position. The remaining switches 204, 206 are for the ejector platen. When the platen is fully retracted switch 206 is made; when it is stroked full forward switch 204 is made.

In operation, when a signal is received by the controller that switch 183 has been made by the cart and a load has been delivered, compactor ram **142*b*, which is at rest on switch 190, is actuated by the controller and will stroke downward to make switches 184, 186 and 188. The compaction ram remains in the down position in which the compaction plate closes chamber opening 150*a* while a load of fibers is tramped. Next, upon receiving signals from the compaction ram down switches and the dogs open switches (192,196), tramping cylinders 100,102 and platen 142*a*, which are at home on the switch 180, are actuated and it will stroke forward to make switch 182. At that time, the dogs are in the open position. On the way back, a linear transducer tracks the position of the tramping cylinders 100, 102. That gives a signal to indicate when the tramping platen is retracted far enough that the dogs can be moved inward to hold the fiber and closing switches 194 and 198. The entire sequence will repeat until the desired weight is contained within the fiber mass F'. At that time, the controller actuates main ram cylinder 104 with ram cylinders 100,102 to stroke forward, and compress the mass in the compression chamber. First, the controller will actuate the dogs which will open on switches 192 and 196, and this signal also satisfies the controller before ram extension. The compactor plate 142*a* remains in the down position on switches 184, 186 and 188 during compression. The ram cylinders come forward from at rest on switch 180 and make switch 182. At that time, and in response to that signal, the controller will actuate the ejector door, which was closed and on switch 200, and the door is moved to open switch 200 which gives a signal that it is OK to eject. The ejector is on switch 206, and is actuated by the controller to extend forward to switch 204 pushing the bale through the sleeve and into the bag. The controller retracts the ejector platen when it makes switch 206**. The controller then moves the elements back to their home positions, and the system is reset to start the entire operation over again.

The operation may vary depending on the size of bale being produced and the embodiment of the apparatus being used. For example, in the case of the embodiment of FIGS. 12–19, a bale having the approximate dimensions of 27×40×54 inches, the normal operation for a complete cycle is about 2 minutes. The machine produces about 30 bales per hour. The tramping cycle lasts about 1 minute and forty seconds, which includes 9 tramps. The transfer cycle lasts about 10 seconds, and the compression cycle lasts 1 minute. The ejection cycle lasts about 50 seconds (30 second extension, and 20 second retract). The tramping cycle (1:40) continues during the transfer, compression, and ejection cycles (2:00). The high production of the machine is due to the offset tramping and compression chambers which allows the tramping of a new fiber mass while the previous fiber mass is compressed and ejected. In the embodiments of FIGS. 20–40, the production is reduced somewhat to approximately 20 bales per hour due to the use of a common tramping and compression chamber.

While a preferred embodiment of the invention has been described using specific terms, such description is for illustrative purposes only, and it is to be understood that changes and variations may be made without departing from the spirit or scope of the following claims.

What is claimed is:

1. A method for producing a strapless bale of compressible fibers comprising:

providing a baler having a tramping chamber in which loose fibers are tramped into a compacted fiber mass, a compression chamber, having a compression section an ejection section having an unobstructed ejection opening adjacent said tramping chamber in which said compacted fiber mass is compressed into a compressed fiber block, and a transfer opening between said tramping chamber and said compression chamber through which said compacted fiber mass is transferred into said compression chamber;

supplying loose compressible fibers into said tramping chamber in a generally uncompressed, non-layered state;

tramping said loose fibers to create said compacted fiber mass of loosely compacted fibers;

retaining said compacted fibers within a tramping chamber while successive deposits of said loose fibers are supplied and compacted in said compacted fiber mass to produce a compacted fiber mass containing a prescribed amount of fibers during a tramping cycle;

transferring said compacted fiber mass from said tramping chamber through said transfer opening directly into said compression section of said compression chamber;

compressing said compacted fiber mass within said compression section in the same direction said fiber mass in tramped to create said compressed fiber block during a compression cycle;

moving said fiber block within said compression chamber from said compression section into said ejection section and ejecting said compressed fiber block through said ejection opening into and through an ejection sleeve having a rectangular cross-section to define an expansion area; and ejecting said compressed fiber block into said flexible bag.

2. The method of claim 1 including compressing said compacted fiber mass using a moveable main platen and a moveable secondary platen, and compressing said compacted fiber mass between said main platen and said bottom platen within said compression section.

3. The method of claim 2 including locating said compression section above said ejection sleeve.

4. The method of claim 3 including providing said compression section with a cross-section generally equal to or less than that of said ejection sleeve.

5. The method of claim 4 including moving said compressed fiber block within said compression chamber into said ejection section by moving said main platen and secondary platen in unison aligning said compressed fiber block with said ejector opening of said ejection section.

6. The method of claim 2 including supplying and tramping said loose fibers in said tramping chamber while said main platen is extended to form a side wall of said tramping chamber during said tramping cycle.

7. The method of claim 2 including supplying said loose fibers to a supply chamber which is laterally off-set from said tramping chamber, and pushing said loose fibers into said tramping chamber from said supply chamber.

8. A method for producing a strapless bale of compressible fibers comprising:

providing a baler having a tramping chamber in which loose fibers are tramped into a compacted fiber mass, a compression chamber having a compression section and an ejection section adjacent said tramping chamber and in which said compacted fiber mass is compressed into a compressed fiber block, a transfer opening between said tramping chamber and said compression chamber through which said compacted fiber mass is transferred into said compression chamber and an unobstructed ejection opening through which said fiber block is removed from said compression chamber;

supplying loose fibers into said tramping chamber;

tramping said loose fibers in said tramping chamber to create said compacted fiber mass of a predetermined amount of loosely compacted fibers during a tramping cycle;

transferring said compacted fiber mass through said transfer opening to said compression section of said compression chamber;

compressing said fiber mass in said compression section in the same direction said fiber bale is tramped to create a compressed fiber block during a compression cycle;

compressing said compacted fiber mass into said fiber block in said compression section using a moveable main platen and a moveable secondary platen by moving said platens first in opposite directions and then in the same direction;

moving said fiber block into said ejection section and ejecting said compressed fiber block through said ejection opening and through an ejection sleeve each having a rectangular cross-section during and ejection cycle;

providing a flexible bag, and ejecting said compressed fiber block into said bag during said ejection cycle to produce a strapless fiber bale.

9. The method of claim 8 wherein said compression chamber includes an opening separating said compression section and said ejection section, the method includes closing said opening with a moveable shelf during the ejection of said compressed fiber block preventing loose fibers entry behind said ejector platen during said ejection cycle.

10. The method of claim 8 wherein said compressed fiber block is ejected through said ejection sleeve using a moveable ejector platen which forms a wall of said compression chamber during compression of said compacted fiber mass.

11. The method of claim 8 including transferring said compacted fiber mass into said laterally off-set compression chamber using at least one transfer plate which forms a wall of said compression chamber.

12. The method of claim 8 including confining said compressed fiber block between said main platen and said secondary platen; and moving to said ejection section said compressed fiber block by moving said main platen and said secondary platen in unison and aligning said compressed fiber block with said ejection opening of said ejection section.

13. The method of claim 12 including forming said compressed fiber block in a compression section of said compression chamber above said ejection section having a cross-section generally equal to or less than that of said ejection sleeve.

14. Apparatus for producing a strapless bale of compressible fibers comprising:

a tramping chamber for receiving a supply of loose compressible fibers;

a reciprocating platen disposed within said tramping chamber for repeatedly tramping successive deposits of said loose fibers to create a compacted fiber mass during a tramping cycle;

a controller for actuating said reciprocating platen repeatedly during said tramping cycle until a compacted fiber mass is formed containing a prescribed amount of fibers;

a compression chamber receiving said compacted fiber mass which includes a compression section in which said compacted fiber mass is compressed in the same direction in which said loose fibers are compacted to produce a compressed fiber block during a compression cycle and an unobstructed ejection section having an ejection opening from which said compressed fiber block is ejected during an ejecting cycle;

a moveable main platen reciprocally carried in said compression chamber and a moveable secondary platen arranged in alignment with said main platen within said compression chamber, said main platen and said secondary platen compressing said compacted fiber mass within said compression section of said compression chamber to form said compressed fiber block, said main platen and said secondary platen then moving said compressed fiber block from said compression section into said ejection section of said compression chamber and into alignment with said ejection opening; and an ejector platen associated with said ejection section of said compression chamber for ejecting said compressed fiber block through said ejection opening from said compression chamber in a direction transverse to the direction of compression.

15. The apparatus of claim 14 wherein said tramping chamber and compression chamber are disposed in axial alignment with each other.

16. The apparatus of claim 15 wherein said tramping chamber and said compression chamber are axially aligned in a vertical direction.

17. The apparatus of claim 14 including at least one reciprocating transfer plate for transferring said compacted fiber mass from said tramping chamber to said compression chamber.

18. The apparatus of claim 17 where in said transfer plate forms a wall of said compression chamber during said compression cycle.

19. The apparatus of claim 14 wherein a compression section is defined between said main platen and secondary platen when located at said compression positions during said compression cycle.

20. The apparatus of claim 19 wherein said compression section is defined in a portion of said compression chamber off-set from said ejection sleeve.

21. The apparatus of claim 20 wherein said compression section has a cross-section generally equal to or less than a cross-section of said ejection sleeve.

22. The apparatus of claim 20 wherein said main platen and secondary platen have a transfer position in which said compressed fiber block is transferred from said compression section to an ejection section and in alignment with said ejection opening.

23. The apparatus of claim 22 wherein said main platen forms a wall of said tramping chamber at said compression position during said ejection cycle so that said tramping cycle may continue during said ejection cycle.

24. Apparatus for producing a strapless bale of compressed fibers comprising:

a fiber supply of loose fibers;

a stationary tramping chamber for receiving said loose fibers;

a reciprocating tramping platen disposed within said tramping chamber for repeatedly tramping deposits of loose fibers to create a compacted fiber mass during a tramping cycle containing a prescribed amount of fibers;

a plurality of retaining elements operatively associated with said tramping chamber of retaining said compacted fibers within said tramping chamber while said successive deposits of said loose fibers are compacted to produce said compacted fiber mass;

a compression chamber having a compression section and an ejection section in which said compacted fiber mass is compressed in the same direction in which said loose fibers are compacted to produce a compressed fiber block during a compression cycle;

a reciprocating main platen for compressing said fibers in said compression section;

said tramping chamber and said compression chamber being generally parallel and laterally next adjacent each other, and a fiber transfer opening being defined between said adjacent tramping chamber and compression chamber for direct transfer of said compacted fiber mass;

at least one reciprocating transfer plate for transferring said compacted fiber mass from said tramping chamber to said compression chamber;

an ejector platen associated with said ejector section for ejecting said compressed fiber block from said compression chamber; and an unobstructed ejection opening including an ejection sleeve through which said compressed fiber block is ejected by said ejector platen, and said ejector sleeve carrying a flexible bag into which said compressed fiber block is ejected from said ejector sleeve during an ejection cycle.

25. The apparatus of claim 24 where in said reciprocating main platen forms a wall of said compression chamber during said ejection cycle.

26. The apparatus of claim 25 wherein a compression section is defined between said main platen and secondary platen at said compression positions in which said fiber mass is compressed during said compression cycle.

27. The apparatus of claim 26 wherein said main and secondary platens are arranged along a vertical axis, and said compression section is defined in a portion of said compression chamber above said ejection sleeve.

28. The apparatus of claim 27 wherein said main and secondary platens are arranged along a vertical axis, and said compression section is defined in a portion of said compression chamber above said ejection section.

29. The apparatus of claim 27 wherein said main platen and secondary platen move in unison to transfer said compressed fiber block into said ejection section generally in alignment with said ejection opening.

* * * * *